US006481333B1

(12) United States Patent
Akasaka et al.

(10) Patent No.: US 6,481,333 B1
(45) Date of Patent: Nov. 19, 2002

(54) POSITIONING DEVICE, CAPACITY CONTROLLER USING POSITIONING DEVICE, AND SPEED CHANGING DEVICE

(75) Inventors: Toshiyuki Akasaka, Yokohama (JP); Sadao Nunotani, Oyama (JP); Takahiro Miyata, Oyama (JP)

(73) Assignee: Komatsu Ltd., Tokyo (JP)

( * ) Notice: Subject to any disclaimer, the term of this patent is extended or adjusted under 35 U.S.C. 154(b) by 6 days.

(21) Appl. No.: 09/599,497

(22) Filed: Jun. 22, 2000

(30) Foreign Application Priority Data

Jun. 24, 1999 (JP) ..... 11-178475
Sep. 8, 1999 (JP) ..... 11-254895
Jun. 12, 2000 (JP) ..... 2000-175932
Jun. 12, 2000 (JP) ..... 2000-175938

(51) Int. Cl.[7] ..... F15B 15/24
(52) U.S. Cl. ..... 92/13.6; 92/13.8
(58) Field of Search ..... 92/13.1, 13.6, 92/13.8, 62, 75; 91/172, 506

(56) References Cited

U.S. PATENT DOCUMENTS 2,484,603 A * 10/1949 Audemar et al. ..... 416/47
3,146,681 A * 9/1964 Sheesley ..... 92/13.6
3,732,785 A * 5/1973 Boydell ..... 91/506
3,958,493 A * 5/1976 Fujita et al. ..... 92/13.6
5,067,323 A * 11/1991 Bennett et al. ..... 92/75

* cited by examiner

*Primary Examiner*—Edward K. Look
*Assistant Examiner*—Thomas E. Lazo
(74) *Attorney, Agent, or Firm*—Varndell & Varndell, PLLC

(57) ABSTRACT

First and second pistons are provided in a body, the first piston is restricted by the body and the second piston, and the second piston is restricted by the body and a second piston restricting part. Thus, the first piston can be stopped at three positions, and the respective stop positions can be adjusted. Therefore, when rotation speeds of left and right rotating bodies are switched among three levels by a hydraulic motor, a difference of the number of rotations between the left and right rotating bodies can be eliminated, and a vehicle can be suppressed from deviating from a course while it is going straight. Further, a mounting area of the hydraulic pump can be decreased and a structure can be made simple. The rotation speed of the hydraulic motor is changed among the three levels by a simple structure and simple control without using a complex structure such as a servo valve and complex control. Further, the rotation speeds of the rotating bodies are switched among three or more levels by discontinuously positioning the piston not only at three positions but also three or more positions. Furthermore, the mounting area of the hydraulic pump is made small.

7 Claims, 21 Drawing Sheets

| PRESSURE-RECEIVING CHAMBER | | | POSITION OF POSITIONING DEVICE CAPACITY OF HYDRAULIC MOTOR | |
|---|---|---|---|---|
| FIRST | SECOND | THIRD | INVENTION | CONVENTIONAL |
| ON | ON | ON | MAX. | MID. |
| ON | ON | OFF | MAX. | MAX. |
| ON | OFF | ON | MID. | MID. |
| ON | OFF | OFF | INDEFINITE | INDEFINITE |
| OFF | ON | ON | MAX. | MIN. |
| OFF | ON | OFF | MAX. | MAX. |
| OFF | OFF | ON | MIN. | MIN. |
| OFF | OFF | OFF | INDEFINITE | INDEFINITE |

FIG.7

| SELECTOR SWITCH \ MOTOR CAPACITY \ PRESSURE-RECEIVING CHAMBER | | FIRST | SECOND | THIRD |
|---|---|---|---|---|
| Lo | MAX. | OFF | ON | ON |
| Mid | MID. | ON | OFF | ON |
| Hi | MIN. | OFF | OFF | ON |

FIG.15(a)

| SELECTOR SWITCH \ MOTOR CAPACITY \ PRESSURE-RECEIVING CHAMBER | | FIRST | SECOND | THIRD |
|---|---|---|---|---|
| Lo | MAX. | OFF | ON | ON |
| Hi | MID. | ON | OFF | ON |
| | MIN. | OFF | OFF | ON |

FIG.15(b)

| SELECTOR SWITCH \ MOTOR CAPACITY \ PRESSURE-RECEIVING CHAMBER | | FIRST | SECOND | THIRD |
|---|---|---|---|---|
| Lo | MAX. | OFF | ON | ON |
| | MID. | ON | OFF | ON |
| Hi | MIN. | OFF | OFF | ON |

FIG.15(c)

| PRESSURE-RECEIVING CHAMBER | | | | POSITION OF POSITIONING DEVICE AND MOTOR CAPACITY |
|---|---|---|---|---|
| FIRST | SECOND | THIRD | FOURTH | |
| ON OR OFF | ON | OFF | OFF | MAX. |
| ON OR OFF | ON | OFF | ON | FIRST MID. |
| ON | OFF | ON | ON OR OFF | SECOND MID. |
| OFF | OFF | ON | ON OR OFF | MIN. |

FIG.18

| SWITCH \ MOTOR CAPACITY \ PRESSURE-RECEIVING CHAMBER | | FIRST | SECOND | THIRD | FOURTH |
|---|---|---|---|---|---|
| Lo | MAX. | ON | ON | OFF | OFF |
| Mid1 | FIRST MID. | ON | ON | OFF | ON |
| Mid2 | SECOND MID. | ON | OFF | ON | OFF |
| Hi | MIN. | OFF | OFF | ON | OFF |

FIG.21

POSITIONING DEVICE, CAPACITY CONTROLLER USING POSITIONING DEVICE, AND SPEED CHANGING DEVICE

BACKGROUND OF THE INVENTION

Field of the Invention

The present invention relates to a positioning device, and more particularly to a positioning device for various types of equipment including control of the capacity of a variable displacement piston motor/pump. And, the invention also relates to a speed changing device of a rotating body using a hydraulic motor.

Today's machines and equipment have been improved in performance such as speedup and labor saving on the basis of the employment of a hydraulic pressure. Especially, the piston motor/pump has high performance and efficiency and is important. This piston motor/pump is extensively used for construction work machines and many other fields.

The hydraulic motor includes a variable displacement motor whose capacity can be changed and a fixed displacement motor whose capacity cannot be changed.

The variable displacement motor will be described with reference to FIG. 8 to FIG. 10.

FIG. 8 shows a sectional diagram of the hydraulic motor disclosed in Japanese Patent Publication No. 4-42550. This piston motor is changed its capacity between two levels.

Specifically, first seat face 58*a* of swash plate 58 housed in casing 55 is contacted to inside wall surface 55*a* of the casing to position the capacity at a maximum capacity position. The capacity is positioned at a minimum capacity position when second seat face 58*b* of the swash plate 58 is contacted to the inside wall surface 55*a* of the casing. The positioning accuracy of the maximum capacity position and the minimum capacity position is determined depending on the accuracy of various parts such as the swash plate 58 and the casing 55.

FIG. 9 shows a sectional diagram of a hydraulic motor different from the one shown in FIG. 8. This motor is an inclined shaft type piston motor. This piston motor changes the capacity position to two levels by pivoting valve plate 46. The valve plate 46 is accommodated in casing 52. The capacity position is variable according to the pivoting of the valve plate 46. Main shaft 51 is an output shaft of the hydraulic motor. The stop position of the valve plate 46 is restricted by minimum capacity adjusting mechanism 54 and maximum capacity adjusting mechanism 53. The minimum capacity adjusting mechanism 54 comprises adjusting screw 54*b* mounted on the casing 52 and nut 54*a* for fixing the adjusting screw 54*b* to the casing 52. One end of the adjusting screw 54*b* protrudes from the inside surface of the casing 52, and the other end protrudes from the outside surface of the casing 52. The maximum capacity adjusting mechanism 53 is also formed in the same way.

The motor has the minimum capacity when the valve plate 46 comes in contact with the leading end of the adjusting screw 54*b* protruded from the inside surface of the casing 52. Similarly, the motor has the maximum capacity when the valve plate 46 comes in contact with the leading end of the adjusting screw 53*b* protruded from the inside surface of the casing 52.

The minimum capacity position is adjusted by the minimum capacity adjusting mechanism 54.

Specifically, the fixed state of the adjusting screw 54*b* by the nut 54*a* is released to adjust the screw-in amount of the adjusting screw 54*b*, and the adjusting screw 54*b* is fixed again to the casing 52 by the nut 54*a*. Thus, the minimum capacity position is adjusted. The maximum capacity position is also adjusted in the same way.

FIG. 10 is a sectional diagram of a conventional three-speed motor. In FIG. 10, like reference numerals are used to indicate the like components of FIG. 9, and their descriptions are omitted.

As shown in FIG. 10, first piston 110 and second piston 120 are disposed in body 44. The first piston 110 is connected to the valve plate 46. In first pressure-receiving chamber 130, the second piston 120 applies a pressure to the first piston 110. Second pressure-receiving chamber 140 applies a pressure in a direction to separate the first piston 110 and the second piston 120 from each other. Third pressure-receiving chamber 150 applies a pressure to the first piston 110 in a direction of the second piston 120.

The second piston 120 has second piston large-diameter section 120*a* having a large outside diameter.

Second piston restricting part is configured by the second piston large-diameter section 120*a* and body inside wall surface 44*a* with which the second piston large-diameter section 120*a* is contacted. Specifically, the large-diameter section 120*a* of the second piston 120 moves toward the first piston 110 to contact the large-diameter section 120*a* with the body inside wall surface 44*a*. Thus, the second piston 120 is stopped. The first piston 110 comes in contact with the second piston 120 whose movement is restricted, and the valve plate 46 is positioned at a middle position.

Servo valve 60 is a control valve for controlling the supply of pressure oil to the second pressure-receiving chamber 140 and the third pressure-receiving chamber 150. The pressure oil discharged from an unillustrated hydraulic pump is supplied to the servo valve 60. And, the pressure oil discharged from an unshown hydraulic pump through an unshown 2-position selector valve is supplied to the first pressure-receiving chamber 130. Switching of the valve position of the 2-position selector valve is controlled so to control the supply and stop of the pressure oil to the first pressure-receiving chamber 130. Thus, the supply of the pressure oil to the first pressure-receiving chamber 130, the second pressure-receiving chamber 140 and the third pressure-receiving chamber 150 is controlled so to switch the position of the first piston 110, namely the position of the valve plate 46, among three positions. Therefore, the capacity position of the motor is changed among three levels of minimum, middle and maximum capacity positions. But, the hydraulic motor shown in FIG. 10 is different from the one shown in FIG. 9 and does not have an adjusting mechanism for adjusting the minimum and maximum capacity positions.

The aforesaid capacity change of the variable displacement motor is used to change the speed of HST (hydrostatic transmission) vehicle.

The HST vehicle such as a bulldozer has its left and right running bodies (wheels or caterpillars) independently driven by left and right hydraulic motors respectively. In other words, the left running body of the vehicle is independently driven and changed its speed by a drive mechanism exclusively disposed for the left side Similarly, the right running body of the vehicle is independently driven and changed its speed by a drive mechanism exclusively disposed for the right side. Each drive mechanism comprises a hydraulic pump and a hydraulic motor.

When the HST vehicle is instructed to run at the same number of left and right rotations, namely to run straight, it causes a deviation from the course if the left and right motor capacities are different.

Therefore, the HST vehicle whose left and right running bodies are independently driven is demanded to have improved accuracy for the capacity control of the left and right variable displacement piston motors so to run without causing a deviation from the course when straight-ahead running is instructed.

And, it is also demanded to simplify a device for controlling the capacity of the variable displacement piston motor.

Besides, it is also said generally that the installing space for the hydraulic equipment mounted to the HST vehicle is limited. Therefore, it is demanded to decrease a mounting area of the hydraulic equipment.

But, there is not any conventional variable displacement piston motor which satisfies the aforesaid demands. Descriptions will be made as follows.

The piston motor of the aforesaid publication shown in FIG. 8 is mainly applied to a vehicle such as a hydraulic excavator requiring two speeds of high and low. The hydraulic excavator adjusts the pump capacity only and does not adjust the motor capacity when the pump capacity is adjusted in order to prevent the deviation from the course because its workability is better than adjusting the motor capacity in view of the mounted positions of the pump and the motor.

The HST vehicle often adjusts the motor only, because its workability is very poor when the pump capacity is adjusted to prevent the deviation from the course in view of the mounted positions of the pump and the motor.

When the hydraulic motor shown in FIG. 9 is applied to the HST vehicle, a difference in rotation speeds between the left and right hydraulic motors is remedied by adjusting the respective capacity positions of the left and right hydraulic motors. Therefore, a deviation from the course of the vehicle can be remedied.

But, the adjustment of the capacity position of the hydraulic motor shown in FIG. 9 is limited to two positions of minimum and maximum capacity positions. When this hydraulic motor is mounted to the HST vehicle, there is a problem of necessity to enlarge the maximum discharge capacity of the hydraulic pump for supplying the pressure oil to the hydraulic motor. This point will be described with reference to FIG. 11.

FIG. 11(*a*) shows the properties of a hydraulic motor (hereinafter called the "2-speed motor") which changes its capacity position between two positions. In FIG. 11(*a*), the horizontal axis indicates the vehicle speed, and the vertical axis indicates traction (torque). The short dashed line in FIG. 11(*a*) indicates the property of the hydraulic motor when its capacity is adjusted to minimum capacity q Mmin, and the solid line indicates the property of the hydraulic motor when its capacity is adjusted to maximum capacity q Mmax.

Meanwhile, FIG. 11(*b*) shows the properties of a hydraulic motor (hereinafter called the "3-speed motor") which changes its capacity position to three positions. In FIG. 11(*b*), the horizontal axis indicates the vehicle speed, and the vertical axis indicates traction (torque). The short dashed line in FIG. 11(*b*) indicates the property of the hydraulic motor when its capacity is adjusted to the minimum capacity q Mmin, the solid line indicates the property of the hydraulic motor when its capacity is adjusted to the maximum capacity q Mmax, and the alternate long and short dash line indicates the property of the hydraulic motor when its capacity is adjusted to middle capacity q Mmean. In FIGS. 11(*a*) and 11(*b*), the region between vehicle speeds V1 and V2 is a work region that work is mainly conducted. The region between vehicle speeds V2 and V3 is a running region that the vehicle mainly runs.

In FIGS. 11(*a*), (*b*), traction at a low speed (V1) becomes maximum MAX. In designing the vehicle or the motor, the maximum capacity q Mmax of the hydraulic motor is determined depending on a level of the maximum traction MAX.

The 2-speed motor shown in FIG. 11(*a*) needs that the vehicle speed is adjusted to the maximum vehicle speed V2 of the work region with the maximum capacity q Mmax retained.

Pump capacity Q Pmax of the hydraulic pump is determined by the following equation (2). In the following equation, it is determined that the engine speed is NE, the motor rotation speed is NM, the pump efficiency is ηPV, and the motor efficiency is ηMV.

$$Q\ P\mathrm{max}\cdot NE\cdot \eta PV = q\ M\mathrm{max}\cdot NM/\eta MV \quad (1)$$

$$Q\ P\mathrm{max} = (q\ M\mathrm{max}\cdot NM/NE)\cdot(1/\eta MV\cdot \eta PV) \quad (2)$$

The 3-speed motor shown in FIG. 11(*b*) needs the vehicle to have the maximum vehicle speed V2 of the work region with the middle capacity q Mmean retained. Pump capacity Q' Pmax of the hydraulic pump is determined by the following equation (4).

$$Q'P\mathrm{max}\cdot NE\cdot \eta PV = q\ M\mathrm{mean}\cdot NM/\eta MV \quad (3)$$

$$Q'P\mathrm{max} = (q\ M\mathrm{mean}\cdot NM/NE)\cdot(1/\eta MV\cdot \eta PV) \quad (4)$$

The above equations (2) and (4) are compared as follows:

$$q\ M\mathrm{max} > q\ M\mathrm{mean} \quad (5),$$

then, $$Q\ P\mathrm{max} > Q'P\mathrm{max} \quad (6)$$

Therefore, when the 2-speed motor is used, the maximum discharge capacity of the hydraulic pump must be made larger as compared with the case of using the 3-speed motor.

Thus, when the 2-speed motor shown in FIG. 9 is mounted to the HST vehicle, there is a disadvantage that the hydraulic pump is required to have a larger maximum discharge capacity. In other words, the 2-speed motor must be designed to have a larger hydraulic pump than the 3-speed motor has.

When the conventional 3-speed hydraulic motor shown in FIG. 10 is mounted to the HST vehicle which has its left and right running bodies provided with the drive mechanisms comprising the hydraulic pump and the hydraulic motor respectively so that the left and right running bodies are independently driven, the capacity positions of the left and right hydraulic motors cannot be adjusted. Therefore, the vehicle may deviate from the course due to a difference in the number of rotations between the left and right hydraulic motors.

The first piston 110 and the second piston 120 shown in FIG. 10 have a different outside diameter. And, the same piston has a different outside diameter depending on its portions. Therefore, the first piston 110 and the second piston 120 have a complex structure. Besides, the body 44 for accommodating the pistons 110, 120 has a complex structure.

It is easy to apply the adjusting mechanism of FIG. 9 to the technique of FIG. 10. But, the adjustment cannot be made at the middle capacity position. Therefore, there is still a problem that a deviation from the course is caused when the vehicle goes straight at the middle capacity position.

Therefore, it is a first object of the present invention to provide a positioning device which has a simple structure and can adjust at all three positions and a motor/pump using this positioning device.

And, it is a second object of the invention to provide a speed changing device for left and right rotating bodies using a hydraulic motor which can remedy a difference in the number of rotations between the left and right rotating bodies when the rotation speeds of the left and right rotating bodies are changed among three levels.

As described above, when the 2-speed motor is used in order to obtain the same maximum vehicle speed V2, it is necessary to increase the maximum discharge amount of the hydraulic pump and to enlarge the size of the hydraulic pump as compared with the case of using the 3-speed motor. This tendency becomes more conspicuous when the number of changes of the hydraulic motor speed is increased to more multiple levels. Therefore, when the number of speed changes of the hydraulic motor is increased to three levels or more, the maximum discharge amount of the hydraulic pump can be made smaller and the size of the hydraulic pump can be decreased as compared with a case that the 2-speed motor is used. In other words, when the positioning number of the positioning device is increased to three or more, the size of the hydraulic equipment such as the hydraulic pump can be made smaller as compared with a case that the positioning device having the positioning number two is used.

But, the structures of the positioning device and hydraulic motor and the control become complex because the position of the first piston 110 is continuously changed by the servo valve 60 according to the prior art of FIG. 10. The prior art of FIG. 10 is a technique to position the rotation speed of the hydraulic motor at three positions by the positioning device. And, there was not a technology that the rotation speed of the hydraulic motor is positioned at four levels or more by the positioning device.

It is a third object of the present invention to make positioning at three positions or more by a simple structure and simple control without using the complex structure such as a servo valve and control and to change the rotation speed of the hydraulic motor to three levels or more.

OBJECTS AND SUMMARY OF THE INVENTION

In order to achieve the first object of the invention, a first invention of the present invention comprises:

a first piston (11) and a second piston (12) in a body (44), the first piston (11) having a position restricted by the body (44) and a position corresponding to the position of the second piston (12) as stop positions, and the second piston (12) having a position restricted by the body (44) and a position restricted by second piston restricting part **(40*b*)** as stop positions;

a middle position adjusting mechanism (40) for adjusting the stop position of the second piston (12) restricted by the second piston restricting part **(40*b*)**;

a first pressure chamber (13) for applying a pressure to the second piston (12) in a direction of the first piston (11);

a second pressure chamber (14) for applying a pressure in a direction to separate the first piston (11) and the second piston (12) from each other; and a third pressure chamber (15) for applying a pressure to the first piston (11) in a direction of the second piston (12).

The first invention will be described with reference to FIG. 1, FIG. 2 and FIG. 3.

The body 44 is provided with the first piston 11 and the second piston 12. The first piston 11 stops at the position restricted by the body 44 and the position corresponding to the position of the second piston 12. The second piston 12 stops at the position restricted by the body 44 and the position restricted by the second piston restricting part **40*b*. The first pressure chamber 13 applies a pressure to the second piston 12 in a direction of the first piston 11. The second pressure chamber 14 applies a pressure in a direction to separate the first piston 11 and the second piston 12 from each other. The third pressure chamber 15 applies a pressure to the first piston 11 in a direction of the second piston 12. And, the supply of the pressure oil to the first, second and third pressure-receiving chambers 13, 14 and 15 is controlled, so that the first piston 11 is positioned at the middle position to come in contact with the second piston 12 whose movement is restricted by the second piston restricting part 40*b*. This state is shown in FIG. 2**.

And, the restriction position of the second piston 12 by the second piston restricting part **40*b* is adjusted by the middle position adjusting mechanism 40. Therefore, the stop position of the first piston 11** at the middle position can be adjusted.

The second invention comprises:

first piston (11) and second piston (12) in body (44), the first piston (11) and the second piston (12) having the same outside diameter, the first piston (11) having a position restricted by the body (44) and a position corresponding to the position of the second piston (12) as stop positions, and the second piston (12) having a position restricted by the body (44) and a position restricted by the second piston restricting part **(40*b*)** as stop positions;

a first pressure chamber (13) for applying a pressure to the second piston (12) in a direction of the first piston (11);

a second pressure chamber (14) for applying a pressure in a direction to separate the first piston (11) and the second piston (12) from each other; and a third pressure chamber (15) for applying a pressure to the first piston (11) in a direction of the second piston (12), wherein:

the first and second pistons (11, 12) are positioned according to a difference in pressure-receiving areas to which the pressures of the first, second and third pressure chambers (13, 14, 15) are applied.

The second invention will be described with reference to FIG. 1, FIG. 2 and FIG. 3.

The body 44 is provided with the first piston 11 and the second piston 12. The first piston 11 stops at the position restricted by the body 44 and the position corresponding to the position of the second piston 12. The second stop piston 12 stops at the position restricted by the body 44 and the position restricted by the second piston restricting part **40*b*. The first pressure chamber 13 applies a pressure to the second piston 12 in a direction of the first piston 11. The second pressure chamber 14 applies a pressure to the first piston 11 in a direction to separate the first piston 11 and the second piston 12 from each other. The third pressure chamber 15 applies a pressure to the first piston 11 in a direction of the second piston 12. And, the supply of the pressure oil to the first, second and third pressure-receiving chambers 13, 14 and 15 is controlled to position the first piston 11 at the maximum position away from the second piston 12. This state is shown in FIG. 1. The first piston 11 is positioned at the middle position to come in contact with the second piston 12 whose movement is restricted by the second piston restricting part 40***b*. This state is shown in FIG. 2. And, the first piston 11 is positioned at the minimum position to come in contact with the second piston 12 whose movement is not restricted by the second piston restricting part 40*b*. This state is shown in FIG. 3.

The first piston 11 and the second piston 12 are designed to have the same outside diameter. The first piston 11 is positioned at the maximum, middle or minimum position depending on pressure-receiving area differences ((S2−S3), (S1−S3)) among area S1 of pressure-receiving surface 12*b* of the second piston 12 to which the pressure oil of the first pressure chamber 13 is applied, area S2 of pressure-receiving surface 11*a* of the first piston 11 to which the pressure oil of the second pressure chamber 14 is applied and area S3 of pressure-receiving surface 11*b* of the first piston 11 to which the pressure oil of the third pressure chamber 15 is applied.

According to the second invention, because the first piston 11 and the second piston 12 are designed to have the same outside diameter, the first piston 11 and the second piston 12 can be formed to have a simple structure, and hole 70 for accommodating these pistons 11, 12 can be configured to have a simple structure with the same diameter along any parts of the hole 70. Therefore, there are obtained effects such as facilitation of a process to produce the positioning device.

A third invention relates to the first and second inventions wherein the first piston (11) is connected to a capacity control member of the variable displacement piston motor/pump to control a capacity position of the variable displacement piston motor/pump.

The third invention will be described with reference to FIG. 4, FIG. 5 and FIG. 6.

According to the third invention, the first piston 11 is connected to valve plate 46 of the variable displacement piston motor (pump). When the first piston 11 is positioned, the valve plate 46 is positioned at the corresponding position, and the capacity position of the variable displacement piston motor (pump) is positioned.

Accordingly, the hydraulic motor of the third invention can adjust the middle capacity position. Therefore, when two hydraulic motors are used, a difference of the number of rotations between the left and right hydraulic motors can be eliminated when the hydraulic motors are changed their speeds to the middle capacity position. Thus, a deviation from the course when running straight can be prevented. Besides, according to the third invention, the hydraulic pumps can be designed to have a small capacity and can be made small in size because the capacity position is changed among three levels of the minimum capacity position, the maximum capacity position and the middle capacity position. Accordingly, the hydraulic equipment can be installed in a limited space.

According to the third invention, because the first piston 11 and the second piston 12 are designed to have the same outside diameter, they can be made to have a simple structure, and hole 70 for accommodating these pistons 11, 12 can be formed to have a simple structure having the same diameter at any part of it. Accordingly, there are obtained effects such as facilitation of a process to produce the positioning device.

A fourth invention relates to the first and second inventions, wherein the first piston (11) is connected to a capacity control member of the variable displacement piston motor/pump to control a capacity of the variable displacement piston motor/pump, and wherein the capacity controller comprises adjusting means (54) for adjusting a minimum capacity of the variable displacement piston motor/pump.

The fourth invention will be described with reference to FIG. 4, FIG. 5 and FIG. 6.

According to the fourth invention, the first piston 11 is connected to valve plate 46 of the variable displacement piston motor (pump). After the first piston 11 is positioned, the valve plate 46 is positioned at the corresponding position, and the capacity position of the variable displacement piston motor (pump) is positioned.

And, the movement of the first piston 11 which is moved to the minimum capacity position is restricted by the minimum capacity position restricting means 54*b*. The restricting position of the first piston 11 is adjusted by the adjusting means 54.

Thus, the hydraulic motor of the fourth invention can adjust the middle capacity position. Besides, according to the fourth invention, the capacity of the hydraulic pump can be made small and the hydraulic pump can be made small accordingly, because the capacity position is changed in three levels of the minimum capacity position, the maximum capacity position and the middle capacity position. Therefore, the hydraulic equipment can be installed in a limited space.

According to the fourth invention, because the first piston 11 and the second piston 12 are designed to have the same outside diameter, they can be made to have a simple structure, and hole 70 for accommodating these pistons 11, 12 can be formed to have a simple structure having the same diameter at any part of it. Accordingly, there are obtained effects such as facilitation of a process to produce the positioning device.

Besides, according to the fourth invention, the position of the first piston 11 which is positioned at the minimum capacity position is adjusted. The minimum capacity position is susceptible to the hydraulic motor (pump). According to the fourth invention, the minimum capacity position which is largely different and variable among individuals can be adjusted readily.

To achieve the second object, a fifth invention is a speed changing device of rotating bodies using hydraulic motors, comprising left and right variable displacement hydraulic motors (9), (9') which are respectively installed for left and right rotating bodies and drive to rotate the left and right rotating bodies; hydraulic pumps (3), (3') which respectively supply pressure oil to the left and right hydraulic motors (9), (9'); and speed switching means which changes rotation speeds of the left and right rotating bodies among three levels of rotation speeds by switching capacity positions of the left and right variable displacement hydraulic motors (9), (9'), among three capacity positions, wherein:

adjusting means is provided for adjusting so that the rotation speeds of the left and right rotating bodies are made identical for each of the three levels of rotation speeds of the left and right rotating bodies.

The fifth invention will be described with reference to FIG. 1 and FIG. 13.

When the capacity positions of the left and right variable displacement hydraulic motors 9, 9' are switched to the minimum capacity position, the rotation speeds of the left and right rotating bodies 100, 100' are switched to the maximum rotation speed. At this point, the hydraulic motors 9, 9' are adjusted to have the same minimum capacity position by the adjusting means 54. Thus, the left and right rotating bodies 100, 100' have the same rotation speed.

When the capacity positions of the left and right variable displacement hydraulic motors 9, 9' are switched to the middle capacity position, the rotation speeds of the left and right rotating bodies 100, 100' are switched to the middle rotation speed. At this point, the left and right hydraulic motors 9, 9' are adjusted to have the same middle capacity position by the adjusting means 40. Thus, the left and right rotating bodies 100, 100' have the same rotation speed.

When the capacity positions of the left and right variable displacement hydraulic motors 9, 9' are switched to the maximum capacity position, the rotation speeds of the left and right rotating bodies 100, 100' are switched to the minimum rotation speed. At this point, the left and right hydraulic motors 9, 9' are adjusted to have the same maximum capacity position by the adjusting means 53. Thus, the left and right rotating bodies 100, 100' have the same rotation speed.

According to the fifth invention, when the rotation speeds of the left and right rotating bodies 100, 100' are switched among the three levels by the hydraulic motors 9, 9', a difference of the number of rotations between the left and right rotating bodies 100, 100' can be eliminated.

Besides, according to the fifth invention, the capacity of the hydraulic pump can be made small, and the hydraulic pump can be made small in size because the capacity positions of the left and right variable displacement hydraulic motors 9, 9' are changed among the three levels. Therefore, the cost of hydraulic equipment is reduced, and the hydraulic equipment can be installed in a limited space. And, the vehicle performance can be improved because the hydraulic pumps and the hydraulic motors can be used under the conditions efficient for the pressures and capacities of the hydraulic pump and the hydraulic motor.

A sixth invention relates to the fifth invention, wherein the speed switching means switches the rotation speed to a first rotation speed at which the capacity positions of the left and right variable displacement hydraulic motors (9), (9') become a maximum capacity position, and the rotation speeds of the left and right rotating bodies become a minimum speed;

a second rotation speed at which the capacity positions of the left and right variable displacement hydraulic motors (9), (9') become a middle capacity position, and the rotation speeds of the left and right rotating bodies become a middle speed; and a third rotation speed at which the capacity positions of the left and right variable displacement hydraulic motors (9), (9') become a minimum capacity position, and the rotation speeds of the left and right rotating bodies become a maximum speed; and automatically switches between the first rotation speed and the second rotation speed.

According to the sixth invention, a difference of the number of rotations between the left and right rotating bodies 100, 100' can be eliminated when the rotation speeds of the left and right rotating bodies 100, 100' are switched among the three levels by using the hydraulic motors 9, 9' in the same way as the fifth invention.

Besides, according to the sixth invention, the switching between the first rotation speed and the second rotation speed is made automatically. The range between the first rotation speed and the second rotation speed is a work area of a low rotation speed with high torque. According to a seventh invention, the manual speed change in the work region requiring torque is unnecessary, and the operability in the work region can be improved.

The seventh invention relates to the fifth invention, wherein the speed switching means switches the rotational speed to:

a first rotation speed at which the capacity positions of the left and right variable displacement hydraulic motors (9), (9') become a maximum capacity position, and the rotation speeds of the left and right rotating bodies become a minimum speed;

a second rotation speed at which the capacity positions of the left and right variable displacement hydraulic motors (9), (9') become a middle capacity position, and the rotation speeds of the left and right rotating bodies become a middle speed; and a third rotation speed at which the capacity positions of the left and right variable displacement hydraulic motors (9), (9') become a minimum capacity position, and the rotation speeds of the left and right rotating bodies become a maximum speed; and automatically switches between the second rotation speed and the third rotation speed.

According to the seventh invention, a difference of the number of rotations between the left and right rotating bodies 100, 100' can be eliminated when the rotation speeds of the left and right rotating bodies 100, 100' are switched among the three levels by the hydraulic motors 9, 9' in the same way as the fifth invention.

Besides, the second rotation speed and the third rotation speed are switched automatically according to the seventh invention. The range between the second rotation speed and the third rotation speed is a running region of the high rotation speed with low torque. According to the third invention, the manual speed change in the running region requiring the rotation speed is unnecessary, and the operability in the running region can be improved.

An eighth invention relates to the fifth invention, wherein the speed switching means switches the rotation speed to:

a first rotation speed at which the capacity positions of the left and right variable displacement hydraulic motors (9), (9') become a maximum capacity position, and the rotation speeds of the left and right rotating bodies become a minimum speed;

a second rotation speed at which the capacity positions of the left and right variable displacement hydraulic motors (9), (9') become a middle capacity position, and the rotation speeds of the left and right rotating bodies become a middle speed; and a third rotation speed at which the capacity positions of the left and right variable displacement hydraulic motors (9), (9') become a minimum capacity position, and the rotation speeds of the left and right rotating bodies become a maximum speed; and manually switches among the first rotation speed, the second rotation speed and the third rotation speed.

According to the eighth invention, a difference of the number of rotations between the left and right rotating bodies 100, 100' can be eliminated when the rotation speeds of the left and right rotating bodies 100, 100' are switched among the three levels by using the hydraulic motors 9, 9' in the same way as the fifth invention.

Besides, the switching among the first rotation speed, the second rotation speed and the third rotation speed is made manually according to the eighth invention. According to a ninth invention, when it is not desirable to automatically switch the capacity of the hydraulic motor, the switching can be effected manually as desired.

A ninth invention relates to the fifth invention, wherein the speed switching means switches the rotational speed to:

a first rotation speed at which the capacity positions of the left and right variable displacement hydraulic motors (9), (9') become a maximum capacity position, and the rotation speeds of the left and right rotating bodies become a minimum speed;

a second rotation speed at which the capacity positions of the left and right variable displacement hydraulic motors (9), (9') become a middle capacity position, and the rotation speeds of the left and right rotating bodies become a middle speed; and a third rotation speed at which the capacity positions of the left and right variable displacement hydraulic motors (9), (9') become a minimum capacity position, and the rotation speeds of the left and right rotating bodies become the maximum speed; and selects either automatic switching between the first rotation speed and the second rotation speed or automatic switching between the second rotation speed and the third rotation speed.

According to the ninth invention, a difference of the number of rotations between the left and right rotating bodies 100, 100' can be eliminated when the rotation speeds of the left and right rotating bodies 100, 100' are switched among the three levels by using the hydraulic motors 9, 9' in the same way as the fifth invention.

Besides, the selection can be made between the automatic switching between the first rotation speed and the second rotation speed and the automatic switching between the second rotation speed and the third rotation speed. The range between the first rotation speed and the second rotation speed is a work area of a low rotation speed with high torque. The range between the second rotation speed and the third rotation speed is a running area of a high rotation speed with low torque. According to a tenth invention, when the automatic speed change in the work area is selected depending on the use conditions of the hydraulic motor, the operability in the work area can be enhanced, and the speed change in the running area can be manually made as desired. When the automatic speed change in the running area is selected depending on the use conditions of the hydraulic motor, the operability in the running area is enhanced, and the speed change in the work area is manually made as desired.

In order to achieve the third object, a tenth invention is a positioning device for changing a position of a subject to be positioned depending on a moved position of a piston (11), which comprises:

the piston (11) which moves between both stroke end positions to change the position of the subject to be positioned from a minimum position to a maximum position;

one or two or more restricting members (12, 67) which are positioned at one or two or more middle positions between both the stroke end positions to restrict the movement of the piston (11) at one or two or more middle positions; and position control means which changes the position of the subject to be positioned among three or more positions by the piston (11) and the restricting members (12, 67).

The tenth invention will be described with reference to FIG. 16 and FIG. 17(*d*). The piston 11 moves between the stroke end position shown in FIG. 17(*a*) and the stroke end position shown in FIG. 17(*d*). The first piston 11 moves between both the stroke end positions to change the position of the subject to be positioned from the maximum position to the minimum position.

The third piston 67 is positioned at a first middle position as shown in FIG. 17(*b*), and the second piston 12 is positioned at a second middle position as shown in FIG. 17(*c*). When the first piston 11 comes in contact with the third piston 67, the movement of the first piston 11 is restricted at the first middle position, and when the first piston 11 comes in contact with the second piston 12, the movement of the first piston 11 is restricted by the second middle position.

The first piston 11, the second piston 12 and the third piston 67 are discontinuously positioned at the respective positions.

In other words, when the first piston 11 is positioned at one stroke end position as shown in 17(*a*), the position of the subject to be positioned becomes the maximum position.

When the third piston 67 is positioned at the first middle position and the first piston 11 is positioned to come in contact with the third piston 67 as shown in FIG. 17(*b*), the position of the subject to be positioned becomes the first middle position.

When the second piston 12 is positioned at the second middle position and the first piston 11 is positioned to come in contact with the second piston 12 as shown in FIG. 17(*c*), the position of the subject to be positioned becomes the second middle position.

When the first piston 11 is positioned at the other stroke end position as shown in FIG. 17(*d*), the position of the subject to be positioned becomes the minimum position.

According to the tenth invention, the position of the subject to be positioned can be changed among three or more positions by discontinuously positioning the first piston 11, the second piston 12 and the third piston 67 at the respective positions. Therefore, the subject to be positioned can be positioned among three or more levels by a simple structure and simple control without using a complex structure such as a servo valve and complex control. The hydraulic equipment such as the hydraulic pump can be made small in size because the number of positioning by the positioning device increases to three or more.

To achieve the third object, an eleventh invention is a speed changing device of rotating bodies using a hydraulic motor, comprising a variable displacement hydraulic motor (9) which rotatably drives the rotating bodies; a hydraulic pump (3) which supplies pressure oil to the variable displacement hydraulic motor (9); and speed switching means which changes rotation speeds of the rotating bodies by changing a capacity position of the variable displacement hydraulic motor (9), wherein the speed switching means includes:

a piston (11) which changes the capacity position of the variable displacement hydraulic motor (9) from a minimum capacity position to a maximum capacity position by moving between both stroke end positions;

one or two or more restricting members (12, 67) which restrict the movement of the piston (11) at one or two or more middle positions by being positioned at one or two or more middle positions between both the stroke end positions; and position control means which changes the rotation speeds of the rotating bodies among three or more levels by the piston (11) and the restricting members (12, 67).

The eleventh invention will be specifically described with reference to FIG. 17.

The first piston 11 moves between the stroke end position shown in FIG. 17(*a*) and the stroke end position shown in FIG. 17(*d*). With the movement of the first piston 11 between both stroke end positions, the capacity position of the variable displacement hydraulic motor 9 varies from the maximum capacity position to the minimum capacity position.

The third piston 67 is positioned at the first middle position as shown in FIG. 17(*b*), and the second piston 12 is positioned at the second middle position as shown in FIG. 17(*c*). When the first piston 11 comes in contact with the third piston 67, the movement of the first piston 11 is restricted at the first middle position, and when the first piston 11 comes in contact with the second piston 12, the movement of the first piston 11 is restricted at the second middle position.

The first piston 11, the second piston 12 and the third piston 67 are discontinuously positioned at the respective positions.

In other words, when the first piston 11 is positioned at one stroke end position as shown in FIG. 17(*a*), the capacity position of the variable displacement hydraulic motor 9 becomes the maximum capacity position, and the rotation speed of the rotating body becomes the minimum speed.

And, when the third piston 67 is positioned at the first middle position and the first piston 11 is positioned to come in contact with the third piston 67 as shown in FIG. 17(*b*), the capacity position of the variable displacement hydraulic motor 9 becomes the first middle capacity position, and the rotation speed of the rotating body becomes the first middle speed.

And, when the second piston 12 is positioned at the second middle position and the first piston 11 is positioned to come in contact with the second piston 12 as shown in FIG. 17(*c*), the capacity position of the variable displacement hydraulic motor 9 becomes the second middle capacity position, and the rotation speed of the rotating body becomes the second middle speed.

And, when the first piston 11 is positioned at the other stroke end position as shown in FIG. 17(*d*), the capacity position of the variable displacement hydraulic motor 9 becomes the minimum capacity position, and the rotation speed of the rotating body becomes the maximum speed.

According to the eleventh invention, the rotation speeds of the rotating bodies can be switched among three or more speeds by discontinuously positioning the first piston 11, the second piston 12 and the third piston 67 at the respective positions. Therefore, the rotation speed of the hydraulic motor can be changed among three or more levels by a simple structure and simple control without using a complex structure such as a servo valve and complex control.

Because the number of speed changes of the hydraulic motor is increased to three or more levels, a maximum discharge amount of the hydraulic pump can be made small, and the hydraulic pump can be made small in size.

A twelfth invention relates to the eleventh invention, wherein the position control means comprises:

respective pressure-receiving chambers (13, 14, 15, 68) which apply the pressure oil to the piston (11) and the one or two or more restricting members (12, 67); and pressure oil supply means which previously determines combinations of high and low pressures of the pressure oil supplied to the respective pressure-receiving chambers (13, 14, 15, 68) for the respective rotation speeds of the rotating bodies and supplies the pressure oil having the combinations of high and low pressures corresponding to the rotation speed to be changed to the pressure-receiving chambers (13, 14, 15, 68) respectively.

The twelfth invention will be described with reference to FIG. 17 and FIG. 18.

The first piston 11, the second piston 12 and the third piston 67 are moved when the pressure oil acts on the pressure-receiving chambers 13, 14, 15, 68.

As shown in FIG. 18, the combinations of high and low (ON, OFF) pressures of the pressure oil supplied to the respective pressure-receiving chambers 13, 14, 15, 68 are previously determined for each rotation speed of the rotating body. When the pressure oils having the combinations of the high and low pressures corresponding to the rotation speed to be changed are supplied to the respective pressure-receiving chambers 13, 14, 15, 68, the first piston 11, the second piston 12 and the third piston 67 are discontinuously positioned, and the rotation speed of the rotating body is changed.

According to the twelfth invention, the pressure oils having the combination of high and low pressures corresponding to the rotation speed to which the speed is changed are supplied to the respective pressure-receiving chambers 13, 14, 15, 68 to discontinuously position the first piston 11, the second piston 12 and the third piston 67, so that the hydraulic motor structure and control can be facilitated further more.

BRIEF DESCRIPTION OF THE DRAWINGS

FIG. 7 is a diagram showing the relation between ON/OFF states of supplying pressure oil to first, second and third pressure-receiving chambers and the capacities of hydraulic motors;

FIGS. 15(*a*), 15(*b*) and 15(*c*) are diagrams showing the relation among ON/OFF states of supplying the pressure oil to first, second and third pressure-receiving chambers, the capacities of a hydraulic motor, and the switching states of a selector switch;

FIG. 18 is a diagram showing the relation between the supply of pressure oil to first, second, third and fourth pressure-receiving chambers and the capacities of variable displacement hydraulic motor 9;

FIG. 21 is a diagram showing the relation among ON/OFF states of supplying the pressure oil to first, second, third and fourth pressure-receiving chambers, the capacities of a hydraulic motor and the switching states of a switch.

DETAILED DESCRIPTION OF THE PREFERRED EMBODIMENTS

An embodiment of a positioning device according to the present invention, a capacity controller for a variable displacement piston motor/pump using the positioning device, and a speed changing device of rotating bodies using a hydraulic motor will be described with reference to the accompanying drawings.

In this embodiment, a variable displacement piston motor using a positioning device which can fix at three positions is assumed.

Figure 1:
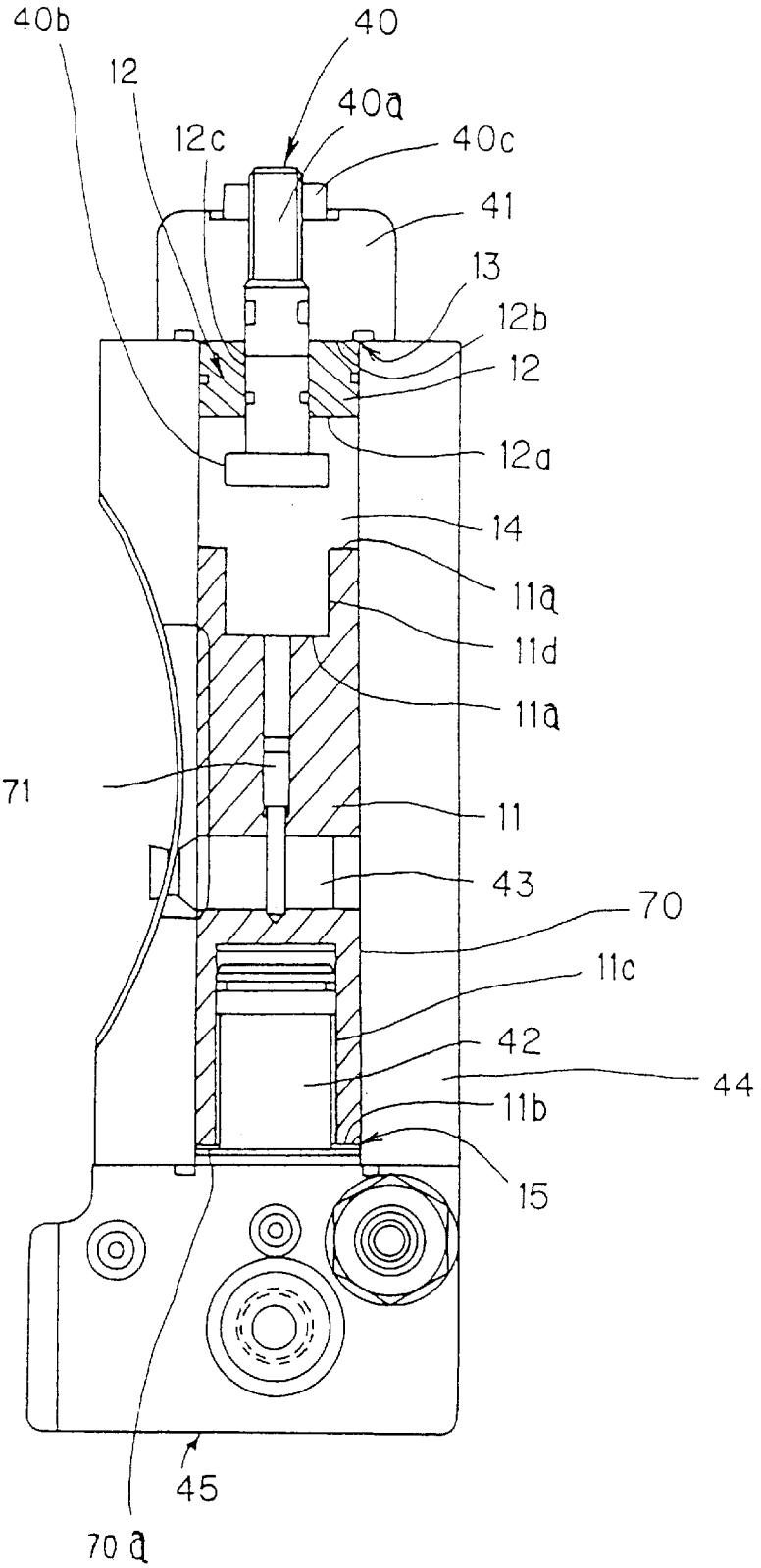
FIG. 1 is a sectional diagram showing a positioning device having a middle capacity adjusting mechanism in its body, which is in a maximum capacity state.

FIG. 1 is a sectional diagram of a positioning device.

A structure of the positioning device used in the invention will be described with reference to FIG. 1.

A positioning device 45 comprises a body 44 and a cover 41. A hole 70 is formed in the body 44. The hole 70 has the same diameter along any part of it.

A first piston 11 and a second piston 12 are placed in the hole 70 of the body 44 with their end faces 11*a*, 12*a* opposed to each other. The first piston 11 and the second piston 12 are slidable in the hole 70 in its longitudinal direction. The first piston 11 and the second piston 12 have the same outside diameter. The first piston 11 and the second piston 12 are designed to have the same diameter at any parts in a longitudinal direction of the pistons. A pin 43 is fixed to the first piston 11 by a screw 71. A member to be positioned is pivotably connected to the leading end of the pin 43.

The second piston 12 has the end face 12*a* opposed to the first piston 11 and an end face 12*b* on the opposite side of the end face 12*a*. The end face 12*b* is opposed to the cover 41. The end face 12*b* of the second piston 12 has a pressure-receiving area S1.

The first piston 11 has the end face 11*a* opposed to the second piston 12 and an end face 11*b* on the opposite side of the end face 11*a*. The end face 11*b* is opposed to a hole end face 70*a*. A first piston-guiding member 42 is formed in the hole end face 70*a*. A hole 11*c* having a diameter corresponding to the outside diameter of the first piston-guiding member 42 is formed in the first piston 11. The first piston 11 moves within the hole 70 with a sliding surface of the first piston-guiding member 42 and a sliding surface of the hole 11*c* of the first piston 11 mutually slid.

Here, the end face 11*a* of the first piston 11 has a pressure-receiving area S2, and the end face 11*b* has a pressure-receiving area S3.

A first pressure-receiving chamber 13 is a pressure-receiving chamber which applies a pressure to the end face 12*b* of the second piston 12. A second pressure-receiving chamber 14 is a pressure-receiving chamber which applies a pressure to the end face 11*a* of the first piston 11. A third pressure-receiving chamber 15 is a pressure-receiving chamber which applies a pressure to the end face 11*b* of the first piston 11.

A middle position adjusting mechanism 40 is fitted to the cover 41. The middle position adjusting mechanism 40 comprises an adjusting screw 40*a* and a nut 40*c*. The bottom end of the adjusting screw 40*a* is fixed to the cover 41 by the nut 40*c*. A second piston restriction section 40*b* is formed on the leading end of the adjusting screw 40*a*. A hole 12*c* having a diameter corresponding to the outside diameter of the adjusting screw 40*a* is formed on the second piston 12. The second piston 12 moves within the hole 70 with a sliding surface of the hole 12*c* of the second piston 12 and a sliding surface of the adjusting screw 40*a* mutually slid.

The second piston restriction section 40*b* decides a stop position of the second piston 12 when it is moved toward the first piston 11.

On the other hand, a hole 11*d* having a diameter corresponding to the outside diameter of the second piston restriction section 40*b* is formed in the first piston 11. The first piston 11 moves within the hole 70 with the sliding surface of the hole 11*d* of the first piston 11 and the sliding surface of the second piston restriction section 40*b* mutually slid.

The middle capacity position is adjusted by the middle position adjusting mechanism 40. Specifically, a fixed state of the adjusting screw 40*a* by the nut 40 is released to adjust a screw-in amount of the adjusting screw 40*a*, and the adjusting screw 40*a* is fixed again to the cover 41 by the nut 40*c*. Thus, the middle capacity position is adjusted.

Figure 2:
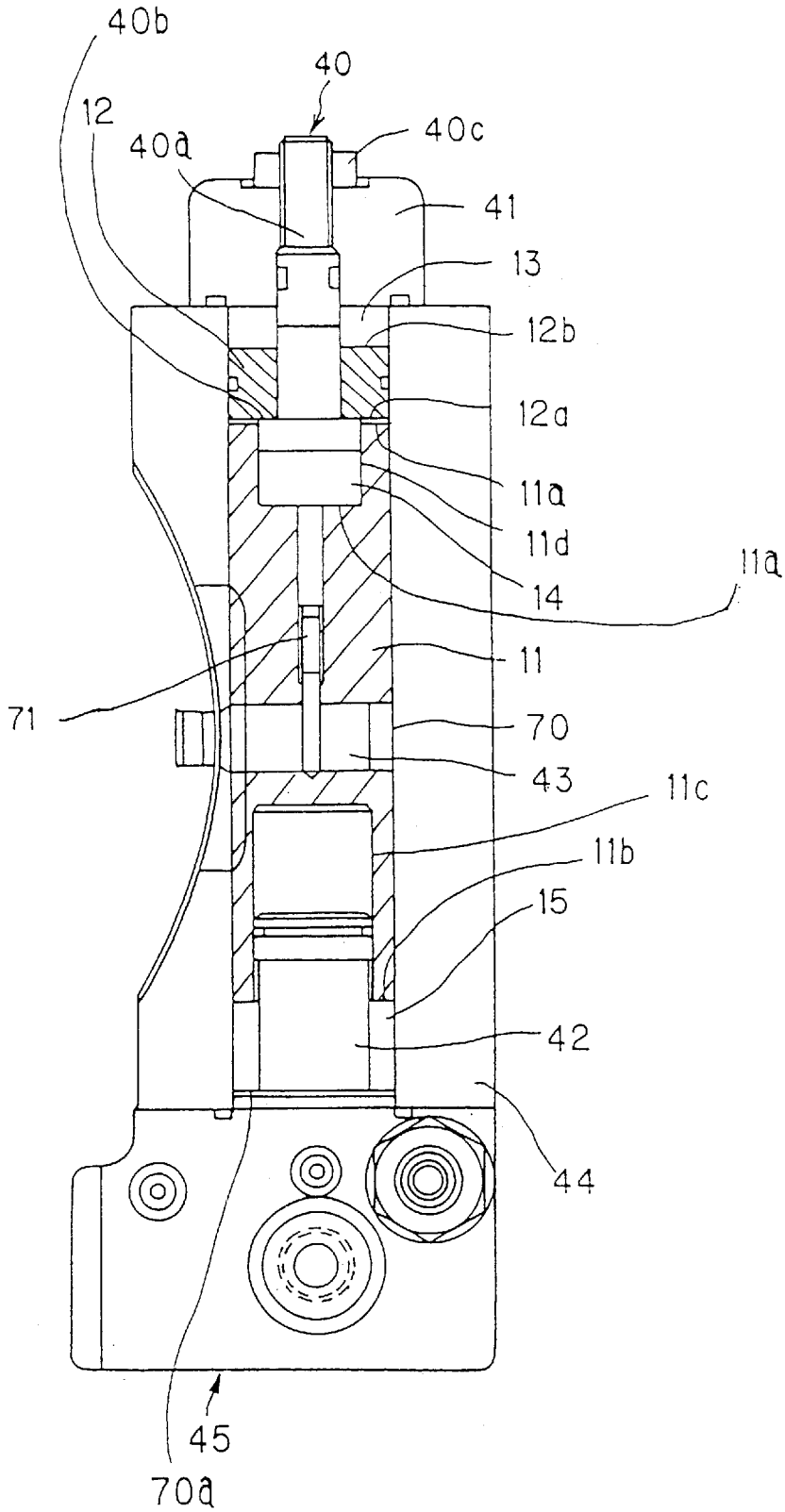
FIG. 2 is a sectional diagram showing the positioning device having the middle capacity adjusting mechanism in its body, which is in a middle capacity state.
Figure 3:
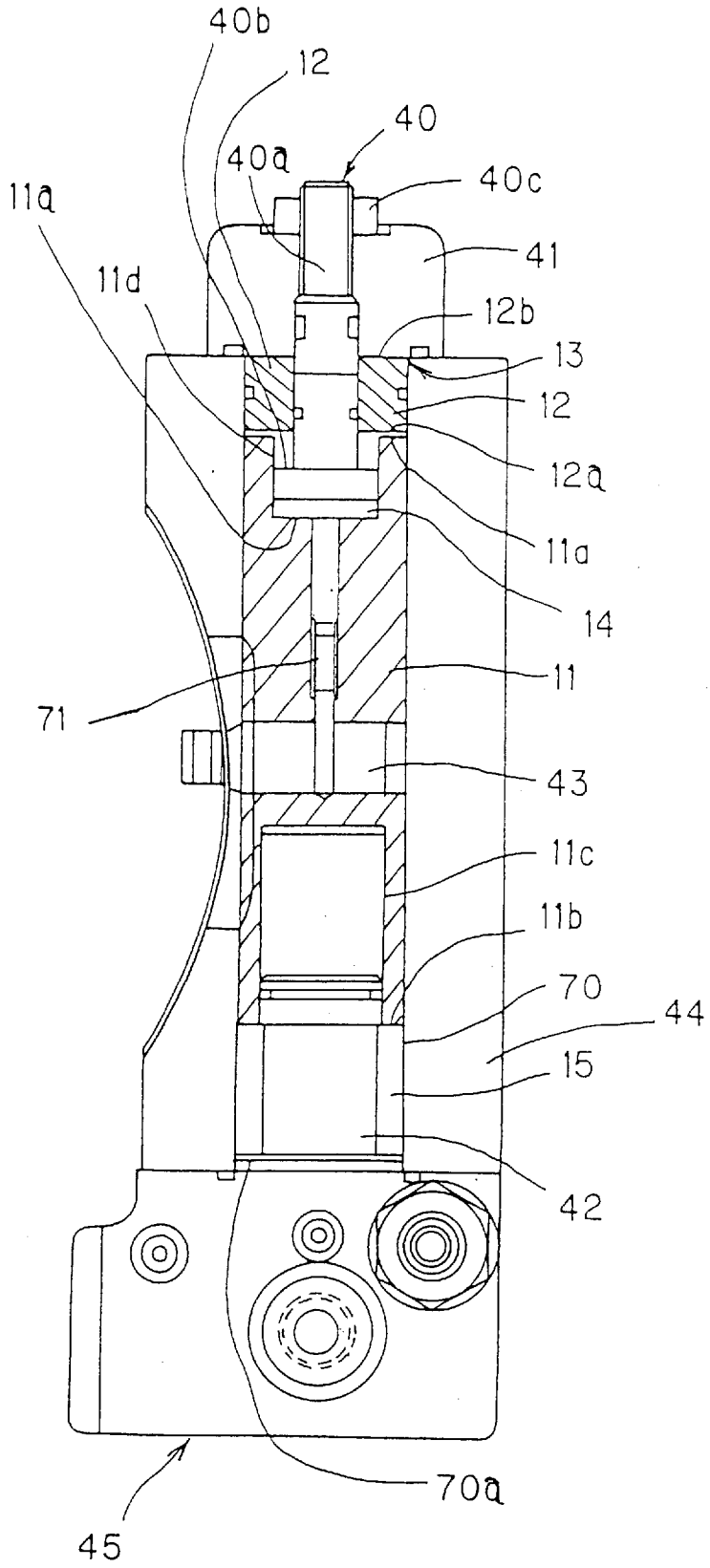
FIG. 3 is a sectional diagram showing the positioning device having the middle capacity adjusting mechanism in its body, which is in a minimum capacity state.

FIG. 2 and FIG. 3 are also sectional diagrams of the positioning device. FIG. 1 to FIG. 3 show three positions where the positioning device can fix the member to be positioned.

Then, an embodiment of the capacity controller for the variable displacement piston motor/pump will be described with reference to the drawings.

Figure 4:
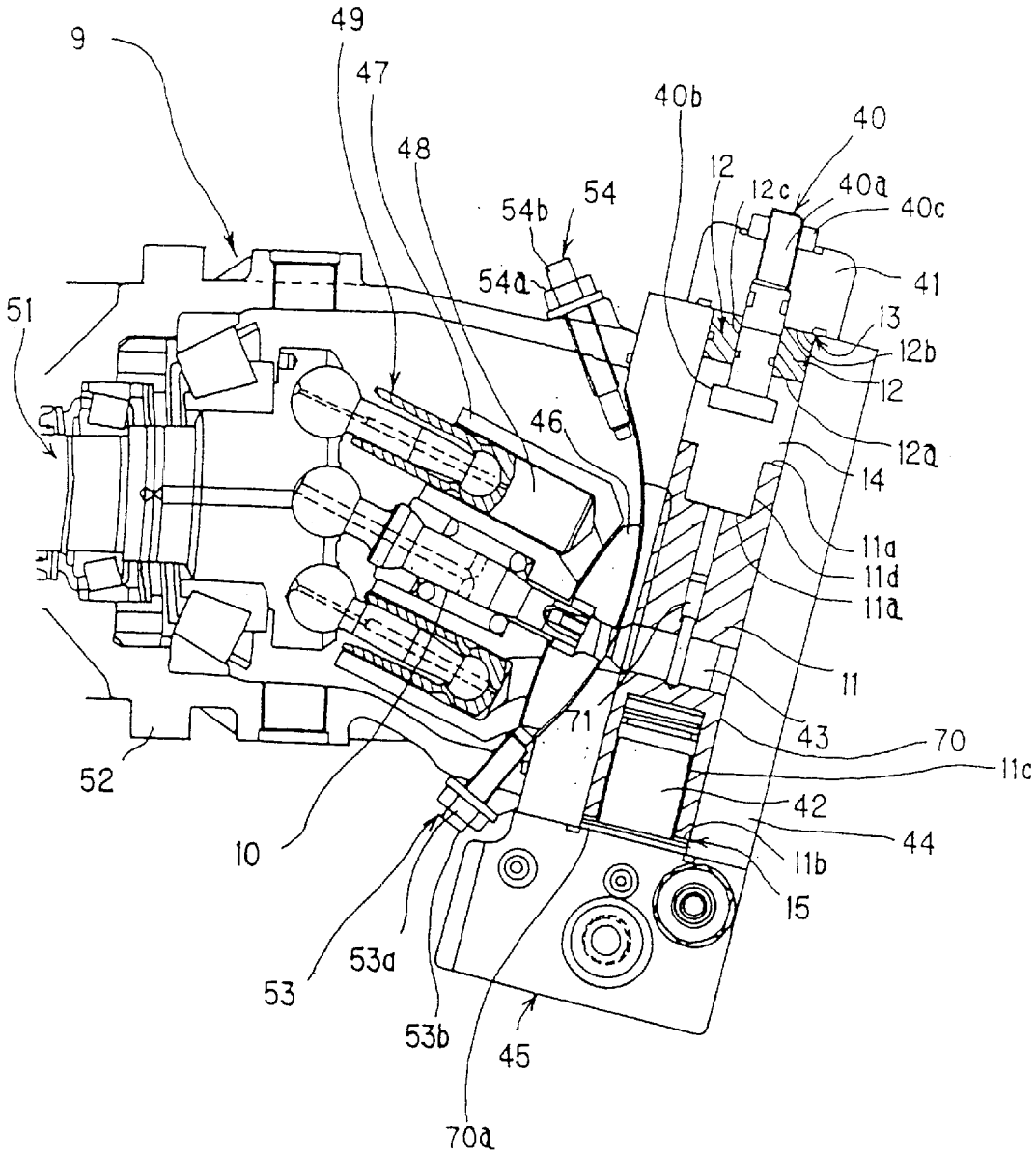
FIG. 4 is a sectional diagram of inclined shaft type axial piston motor 9, which is in a maximum capacity state.

FIG. 4 is a sectional diagram of an inclined shaft type axial piston motor 9.

This piston motor 9 generally comprises a casing 52 which accommodates a cylinder block 47, a valve plate 46 and a main shaft 51, and the positioning device 45 which makes positioning of a capacity position of the piston motor 9 among three levels by positioning the pivoting position of the valve plate 46 in three levels.

The cylinder block 47 accommodates a center shaft 10 and a piston 49. One end of the center shaft 10 is pivotably connected to the main shaft 51. Other end of the center shaft 10 is connected to the valve plate 46. The piston 49 is slidably placed in cylinder 48 formed within the cylinder block 47.

The capacity of the piston motor 9 is variable according to pivoting of the valve plate 46. Specifically, when the valve plate 46 is pivoted, an angle of the center shaft 10 to the main shaft 51 is changed, and a stroke amount of the piston 49 is changed. In other words, a difference of capacity occurs between the pistons 49 and 49 which are mutually opposed with the center shaft 10 between them. The main shaft 51 is an output shaft of the hydraulic motor.

A stop position of the valve plate 46 is restricted by a maximum capacity adjusting mechanism 53 and a minimum capacity adjusting mechanism 54. The minimum capacity adjusting mechanism 54 comprises an adjusting screw 54*b* fitted to the casing 52 and a nut 54*a* for fixing the adjusting screw 54*b* to the casing 52. One leading end of the adjusting screw 54*b* is protruded from the inside surface of the casing 52, and the other leading end is protruded from the outside surface of the casing 52. The maximum capacity adjusting mechanism 53 also has the same structure.

The motor has a minimum capacity when the valve plate 46 is in contact with the leading end of the adjusting screw 54*b* protruded from the inside surface of the casing 52. Similarly, the motor has a maximum capacity when the valve plate 46 is in contact with the leading end of the adjusting screw 53*b* protruded from the inside surface of the casing 52.

The minimum capacity position is adjusted by the minimum capacity adjusting mechanism 54.

Specifically, the fixed state of the adjusting screw 54*b* by the nut 54*a* is released to adjust a screw-in amount of the adjusting screw 54*b*, and the adjusting screw 54*b* is fixed again to the casing 54 by the nut 54*a*. Thus, the minimum capacity position is adjusted. Similarly, the maximum capacity position is adjusted.

Then, the control of the capacity of the piston motor 9 will be described with additional reference to FIG. 7.

FIG. 7 is a diagram showing the relation between ON/OFF of the supply of the pressure oil to the first pressure-receiving chamber 13, the second pressure-receiving chamber 14 and the third pressure-receiving chamber 15 and the capacities of the hydraulic motor 9. In FIG. 7, "ON" indicates that the pressure oil of a high pressure is supplied to the pressure-receiving chamber, and "OFF" indicates that the pressure oil of a low pressure is supplied to the pressure-receiving chamber. The low pressure state means, for example, a state that the supply of the pressure oil is intercepted. For convenience of description, it is assumed that the "high pressure" has magnitude P and the "low pressure" has magnitude O. In FIG. 7, the "Invention" indicates the embodiments shown in FIG. 4 to FIG. 6, while the "Conventional" means the prior art shown in FIG. 10. States actually used in the embodiments shown in FIG. 4 to FIG. 6 are indicated within the heavy lines in FIG. 7.

When the supply of the pressure oil to the respective pressure-receiving chambers 13, 14, 15 is controlled in the combination indicated in the fifth columns from the top and in the heavy line in FIG. 7, the first piston 11 and the second piston 12 have the states as shown in FIG. 4. At this point, the valve plate 46 is positioned at the maximum capacity position.

Specifically, the pressure oil of a high pressure is supplied to the second pressure-receiving chamber 14 and the third pressure-receiving chamber 15. At this point, the first piston 11 has a difference of pressure-receiving surface areas S2−S3(>0) between the pressure-receiving area S2 of the end face 11*a* and the pressure-receiving area S3 of the end face 11*b*. Therefore, force F=(S2−S3)·P is applied to the first piston 11 to move toward hole end face 70*a*. Therefore, the first piston 11 is moved to a position so that the valve plate 46 comes in contact with the leading end of the adjusting screw 53*b* for the maximum capacity adjustment. The valve plate 46 comes in contact with the leading end of the adjusting screw 53*b* for the maximum capacity adjustment before the first piston 11 comes in contact with the hole end face 70*a*. Thus, the first piston 11 is positioned at a position away from the second piston 12. At this point, the valve plate 46 is positioned at the maximum capacity position.

Figure 5:
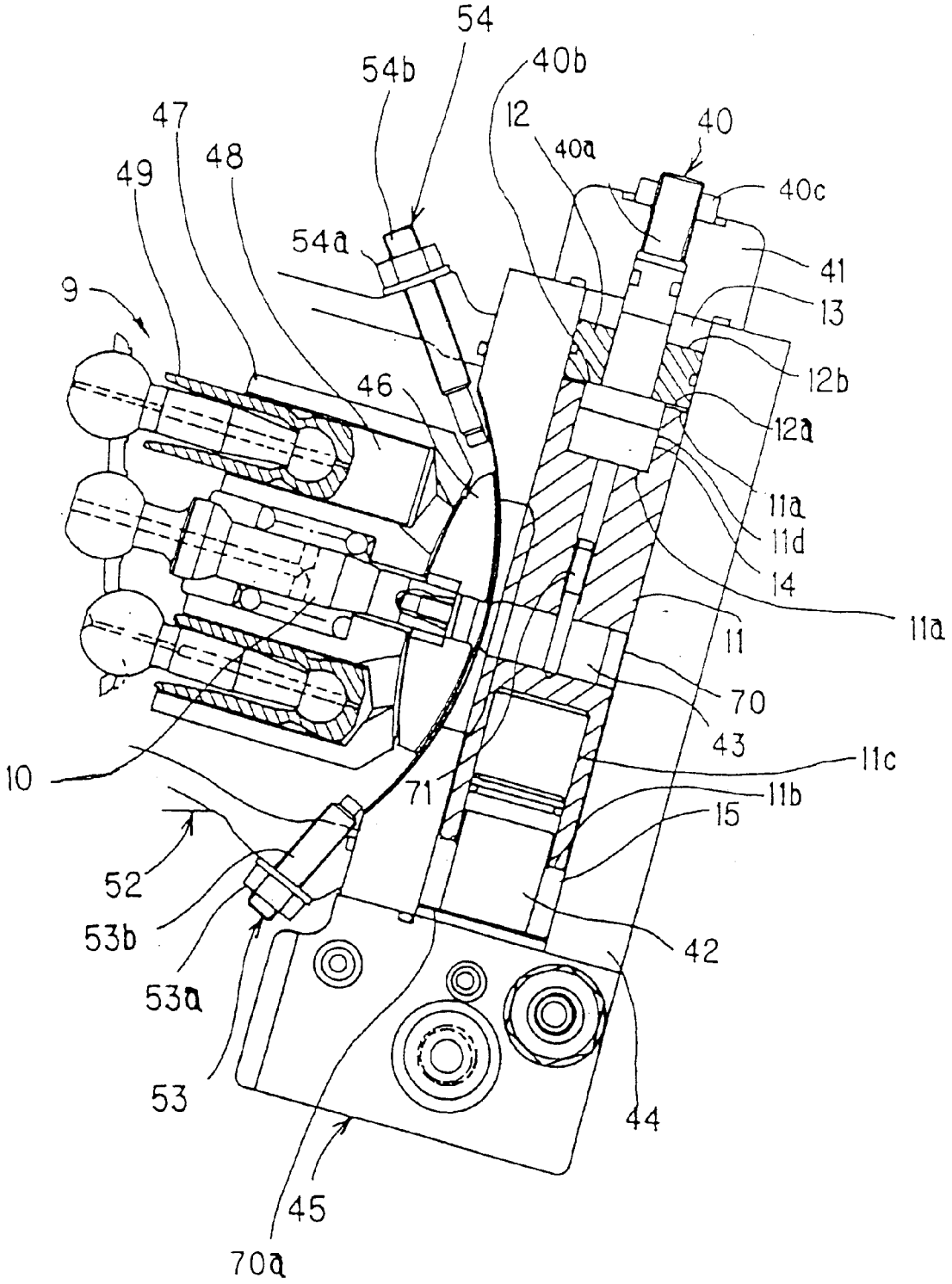
FIG. 5 is a sectional diagram of the inclined shaft type axial piston motor 9, which is in a middle capacity state.
Figure 6:
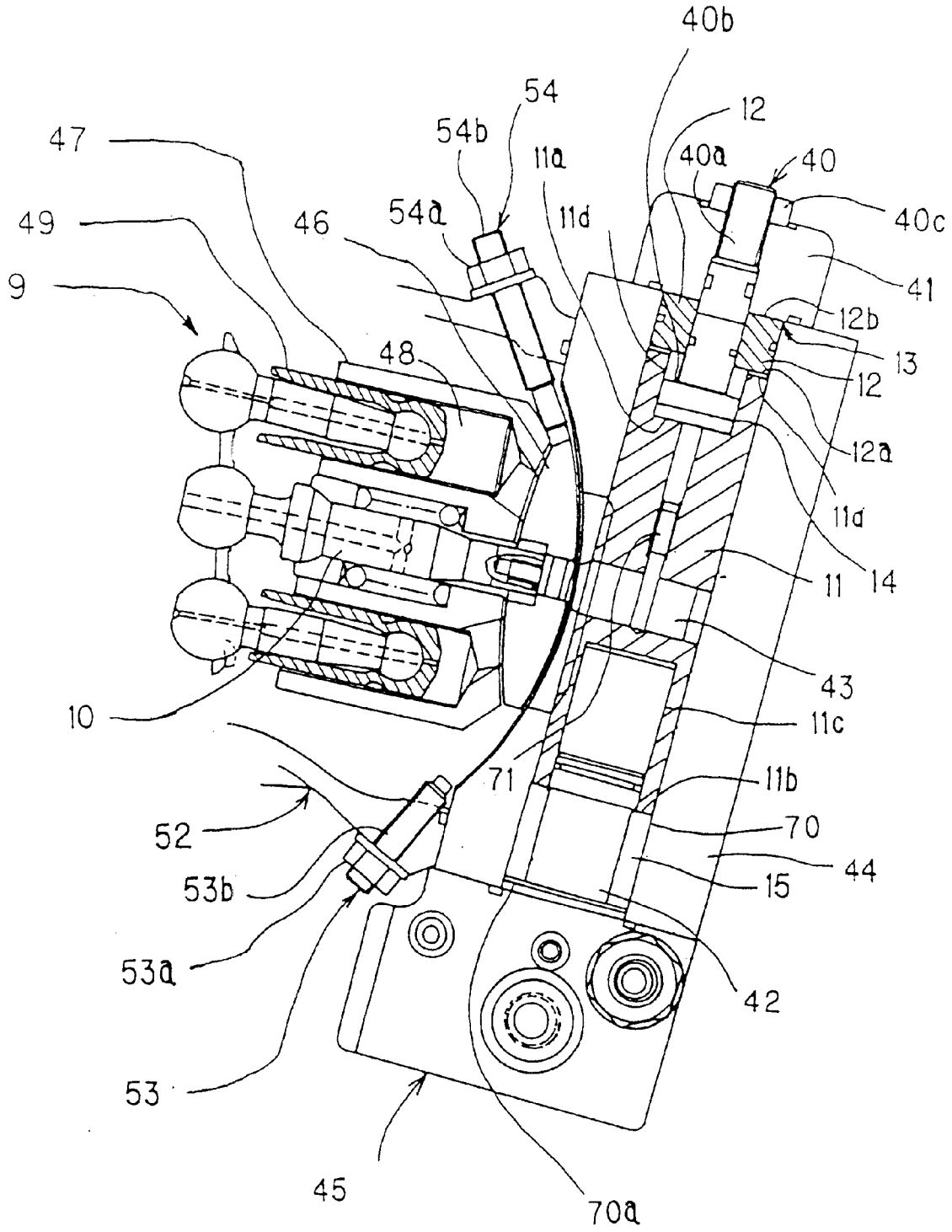
FIG. 6 is a sectional diagram of the inclined shaft type axial piston motor 9, which is in a minimum capacity state.
Figure 8:
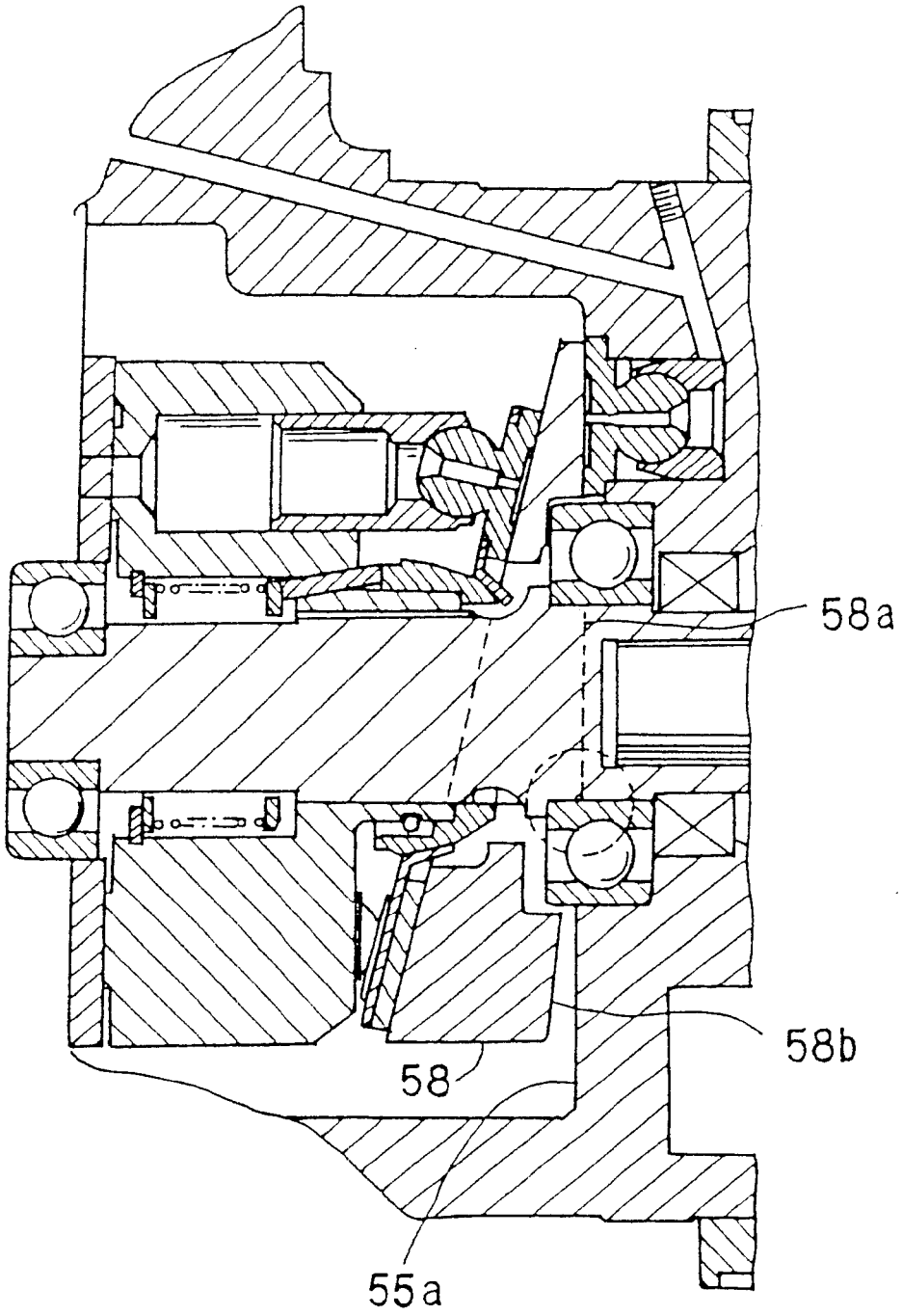
FIG.8 (PRIOR ART)
FIG. 8 is a sectional diagram of a conventional hydraulic motor.
Figure 9:
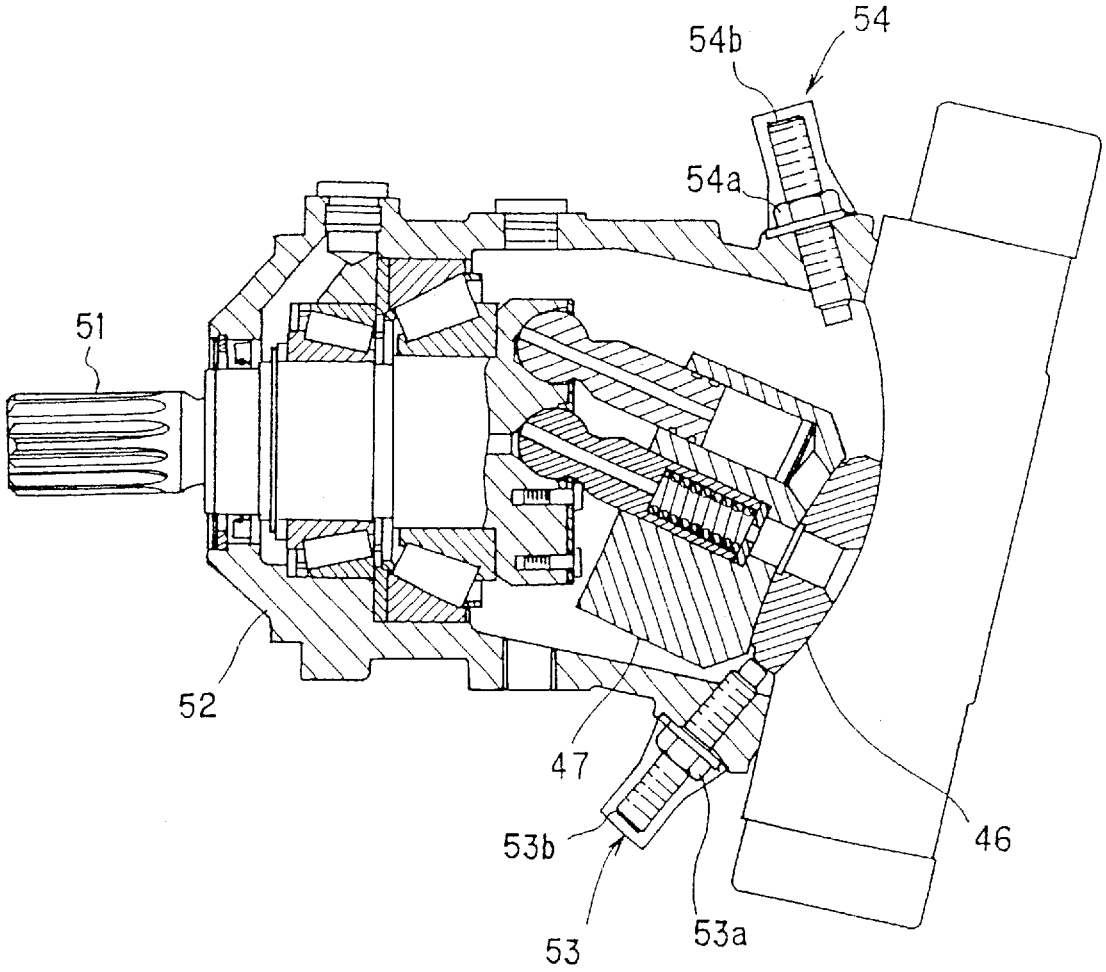
FIG.9 (PRIOR ART)
FIG. 9 is a sectional diagram of the conventional hydraulic motor.

When the supply of the pressure oil to the respective pressure-receiving chambers 13, 14, 15 is controlled in the combination shown in the third columns indicated by a heavy line in FIG. 7, the first piston 11 and the second piston 12 have the state as shown in FIG. 5. At this point, the valve plate 46 is positioned at the middle capacity position.

Specifically, the pressure oil of a high pressure is supplied to the first pressure-receiving chamber 13 and the third pressure-receiving chamber 15. At this point, there is a difference of pressure-receiving surface areas S1−S3(>0) between the pressure-receiving area S1 of the end face 12*a* of the second piston 12 and the pressure-receiving area S3 of the end face 11*b* of the first piston 11. Therefore, force F=(S1−S3)·P is applied to the first piston 11 and the second piston 12 to move toward the hole end face 70*a*. The second piston 12 is contacted to the second piston, restriction section 40*b* of the adjusting screw 40*a*, and the movement of the second piston 12 is restricted. The first piston 11 comes in contact with the second piston 12 which has its movement restricted by the second piston restriction section 40*b*. Thus, the first piston 11 is positioned at the middle position. And, the valve plate 46 is positioned at the middle capacity position.

When the supply of the pressure oil to the respective pressure-receiving chambers 13, 14, 15 is controlled in the combination shown in the seventh columns indicated by a heavy line in FIG. 7, the first piston 11 and the second piston 12 have the state as shown in FIG. 6. At this point, the valve plate 46 is positioned at the minimum capacity position.

Specifically, the pressure oil of a high pressure is supplied to the third pressure-receiving chamber 15. At this point, force F=S3·P acts on the end face 11*b* of the first piston 11 to move toward the second piston 12. Therefore, the first piston 11 moves to a position so that the valve plate 46 kept in contact with the second piston 12 comes in contact with the leading end of the adjusting screw 54*b* for the minimum capacity adjustment. The valve plate 46 comes in contact with the leading end of the adjusting screw 54*b* for the minimum capacity adjustment before the second piston 12 comes in contact with the cover. Thus, the first piston 11 is positioned at a position to come in contact with the second piston 12 whose movement is not restricted by the second piston restriction section 40*b*. At this point, the valve plate 46 is positioned at the minimum capacity position.

The aforesaid embodiment controls the supply of the pressure oil to the respective pressure-receiving chambers 13, 14, 15 in the combination indicated by the heavy-lined frames. But, the capacity position of the valve plate 46 can be changed in another combination shown in FIG. 7.

When the supply of the pressure oil to the respective pressure-receiving chambers 13, 14, 15 is controlled in the combinations shown in the first, second and sixth heavy line frames instead of the combination shown in the fifth heavy line frames in FIG. 7, the first piston 11 can also be positioned in the state shown in FIG. 4, and the capacity position of the valve plate 46 can be positioned at the maximum capacity position.

But, when the supply of the pressure oil to the respective pressure-receiving chambers 13, 14, 15 is controlled in the combinations shown in the fourth and eighth columns, the position of the first piston 11 becomes indefinite, and the capacity position of the valve plate 46 becomes indefinite.

Then, operation to adjust the capacity position of the aforesaid piston motor 9 will be described.

The valve plate 46 of FIG. 4 is positioned at the maximum capacity position. At this point, the maximum capacity position is adjusted by the maximum capacity adjusting mechanism 53.

Specifically, the fixed state of the adjusting screw 53*b* by the nut 53*a* is released to adjust the screw-in amount of the adjusting screw 53*b*, and the adjusting screw 53*b* is fixed again to the casing 52 by the nut 53*a*. Thus, the maximum capacity position is adjusted.

The valve plate 46 of FIG. 5 is positioned at the middle capacity position. Then, the middle capacity position is adjusted by the middle position adjusting mechanism 40.

Specifically, the fixed state of the adjusting screw 40*a* by the nut 40*c* is released to adjust the screw-in amount of the adjusting screw 40*a*, and the adjusting screw 40*a* is fixed again to the cover 41 by the nut 40*c*. Thus, the middle capacity position is adjusted.

The valve plate 46 of FIG. 6 is positioned at the minimum capacity position. Then, the minimum capacity position is adjusted by the minimum capacity adjusting mechanism 54.

Specifically, the fixed state of the adjusting screw 54*b* by the nut 54*a* is released to adjust the screw-in amount of the adjusting screw 54*b*, and the adjusting screw 54*b* is fixed again to the casing 52 by the nut 54*a*. Thus, the minimum capacity position is adjusted.

The embodiment described above assumes the use as the hydraulic motor for HST (hydrostatic transmission) vehicle such as bulldozers. In such a case, the main shaft 51 is connected to a running body (a wheel or a caterpillar) of the HST vehicle.

The HST vehicle such as the bulldozer has its right and left running bodies (wheels or caterpillars) independently driven by the HSTs respectively mounted on the right and left sides. Specifically, the left-side running body of the vehicle is independently driven and changed its speed by the HST exclusive for the left side, namely a pair of hydraulic pump and hydraulic motor. Similarly, the right-side running body of the vehicle is independently driven and changed its speed by the HST exclusive for the right side, namely a pair of hydraulic pump and hydraulic motor.

Some HST vehicles change the speed by changing the capacity of the variable displacement motor. The structures of the variable displacement motor and pump are shown in FIG. 4 to FIG. 7.

As described above, this embodiment can adjust at the middle capacity position, so that a difference in the number of rotations between the left and right hydraulic motors 9 and 9 can be eliminated when the hydraulic motor 9 is changed its speed to the middle capacity position. Therefore, a deviation from the course while running straight can be prevented. Besides, this embodiment changes the capacity position among three levels of minimum, maximum and middle capacity positions, so that the capacity of the hydraulic pump can be made small, and a size of the hydraulic pump can be made compact accordingly. Thus, hydraulic equipment can be mounted in a limited space.

In addition, the first piston 11 and the second piston 12 are designed to have the same outside diameter in this embodiment, so that they can have a simple structure, and the hole 70 accommodating the pistons 11, 12 is designed to have a simple structure such that it has the same diameter along any part of it. Thus, it has an effect that the working to produce the positioning device 45 can be facilitated.

Furthermore, according to this embodiment, the position of the first piston 11 positioned at the minimum capacity position is adjusted. The minimum capacity position is susceptible to the hydraulic motor 9. According to this embodiment, the minimum capacity position which is largely different and variable among individuals can be adjusted with ease.

According to this embodiment, the middle position adjusting mechanism 40 is mounted on the cover 41 of the body 44 along the moving direction of the first piston 11 and the second piston 12. Accordingly, the adjusting work can be performed readily.

Then, the positioning device according to an embodiment different from the positioning device according to the embodiment shown in FIG. 1 to FIG. 3 will be described with reference to FIG. 12. Like reference numerals are used for the like components of the embodiment shown in FIG. 1 to FIG. 3. and their descriptions are omitted.

Figure 12:
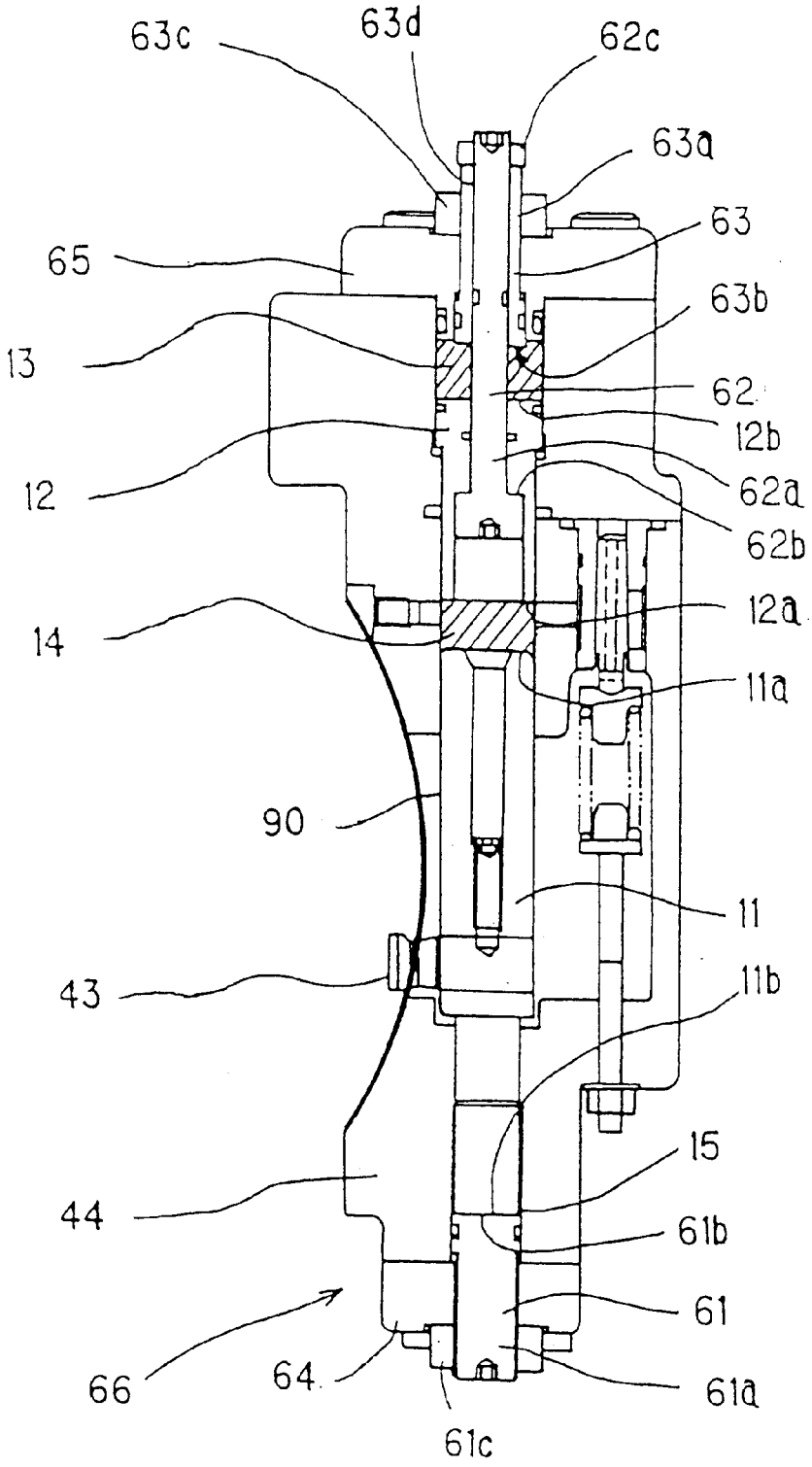
FIG. 12 is a sectional diagram showing a positioning device having respective capacity adjusting mechanisms mounted in its body.

Differences between the positioning device shown in FIG. 12 and the positioning device shown in FIG. 1 to FIG. 3 are a maximum position adjusting mechanism 61 and a minimum position adjusting mechanism 63 which are disposed along the moving direction of the first piston 11 and the second piston 12. And, a middle position adjusting mechanism 62 is mounted on the minimum position adjusting mechanism 63.

Specifically, a hole 90 is formed in a body 44. The first piston 11 and the second piston 12 are disposed in the hole 90 of the body 44 with the end faces 11*a*, 12*a* mutually opposed. A cover 64 is fitted to the body 44 to oppose the end face 11*b* of the first piston 11. A cover 65 is fitted to the body 44 to oppose the end face 12*b* of the second piston 12. This cover 65 corresponds to the cover 41 of FIG. 1 to FIG. 3.

The maximum position adjusting mechanism 61 is fitted to the cover 64. The maximum position adjusting mechanism 61 comprises an adjusting screw 61*a* and a nut 61*c*. The base end of the adjusting screw 61*a* is fixed to the cover 64 by the nut 61*c*. A first piston restricting section 61*b* is formed on the leading end of the adjusting screw 61*a*. The adjusting screw 61*a* is fitted to the same axis as the first piston 11.

The minimum position adjusting mechanism 63 is fitted to the cover 65. The minimum position adjusting mechanism 63 comprises an adjusting screw 63*a* and a nut 63*c*. The base end of the adjusting screw 63*a* is fixed to the cover 65 by the nut 63*c*. Second piston restricting section 63*b* is formed on the leading end of the adjusting screw 63*a*. The adjusting screw 63*a* is fitted to the same axis as the second piston 12.

The middle position adjusting mechanism 62 is disposed on the adjusting screw 63*a* of the minimum position adjusting mechanism 63. The middle position adjusting mechanism 62 comprises an adjusting screw 62*a* and a nut 62*c*. The base end of the adjusting screw 62*a* is fixed to the base end of the adjusting screw 63*a* of the minimum position adjusting mechanism 63 by the nut 62*c*. A second piston restricting section 62*b* is formed on the leading end of the adjusting screw 62*a*. A hole 63*d* having a diameter corresponding to the outside diameter of the adjusting screw 62*a* is formed on the adjusting screw 63*a*, and the adjusting screw 62*a* slides within the hole 63*d*.

A hole 12*c* having a diameter corresponding to the outside diameter of the adjusting screw 63*a* is formed in the second piston 12, and hole 12*d* having a diameter corresponding to the outside diameter of the second piston restriction section 62*b* is formed. The second piston 12 moves in the hole 90 while the hole 12*c* slides in contact with the adjusting screw 63*a* and the hole 12*d* slides in contact with the second piston restricting section 62*b*.

The second piston restricting section 62*b* decides a stop position when the second piston moves toward the first piston 11.

Operation of a positioning device 66 shown in FIG. 12 will be described.

The maximum capacity position is adjusted by the maximum position adjusting mechanism 61.

Specifically, the fixed state of the adjusting screw 61*a* by the nut 61*c* is released to adjust the screw-in amount of the adjusting screw 61*a*, and the adjusting screw 61*a* is fixed again to the cover 64 by the nut 61*c*. Thus, the maximum capacity position is adjusted.

The minimum capacity position is adjusted by the minimum position adjusting mechanism 63.

Specifically, the fixed state of the adjusting screw 63*a* by the nut 63*c* is released to adjust the screw-in amount of the adjusting screw 63*a*, and the adjusting screw 63*a* is fixed again to the cover 65 by the nut 63*c*. Thus, the minimum capacity position is adjusted.

The middle capacity position is adjusted by the middle position adjusting mechanism 62.

Specifically, the fixed state of the adjusting screw 62*a* by the nut 62*c* is released to adjust the screw-in amount of the adjusting screw 62*a*, and the adjusting screw 62*a* is fixed again to the base end of the adjusting screw 63*a* of the minimum position adjusting mechanism 63 by the nut 62*c*. Thus, the middle capacity position is adjusted.

In the embodiment shown in FIG. 12, the minimum position adjusting mechanism 63 and the maximum position adjusting mechanism 61 are also disposed in addition to the middle position adjusting mechanism 62 on the body 44 in the moving direction of the first piston 11 and the second piston 12. Accordingly, the adjusting work can be performed with ease as compared with the minimum capacity adjusting mechanism 54 and the maximum capacity adjusting mechanism 53 which are disposed in the pivoting direction of the valve plate 46 as shown in FIG. 4. The embodiment shown in FIG. 12 is suitable when a space enough for the mechanism to adjust the capacity is not available around the casing 52.

The maximum capacity adjusting mechanism, the middle capacity adjusting mechanism and the minimum capacity adjusting mechanism shown in FIG. 4 to FIG. 6 and FIG. 12 use the adjusting screw and the nut to adjust the capacity position. But, such arrangement is not limitative but an eccentric cam, shim and electromagnetic solenoid may be used to adjust the position, that the movement of the valve plate 46, the first piston 11 or the second piston 12 is restricted, so to adjust the capacity position.

The embodiment shown in FIG. 4 to FIG. 6 assumes an inclined shaft type axial piston motor (pump). But, a swash plate type motor or pump or a radial type motor or pump may be used in the present invention.

Figure 13:
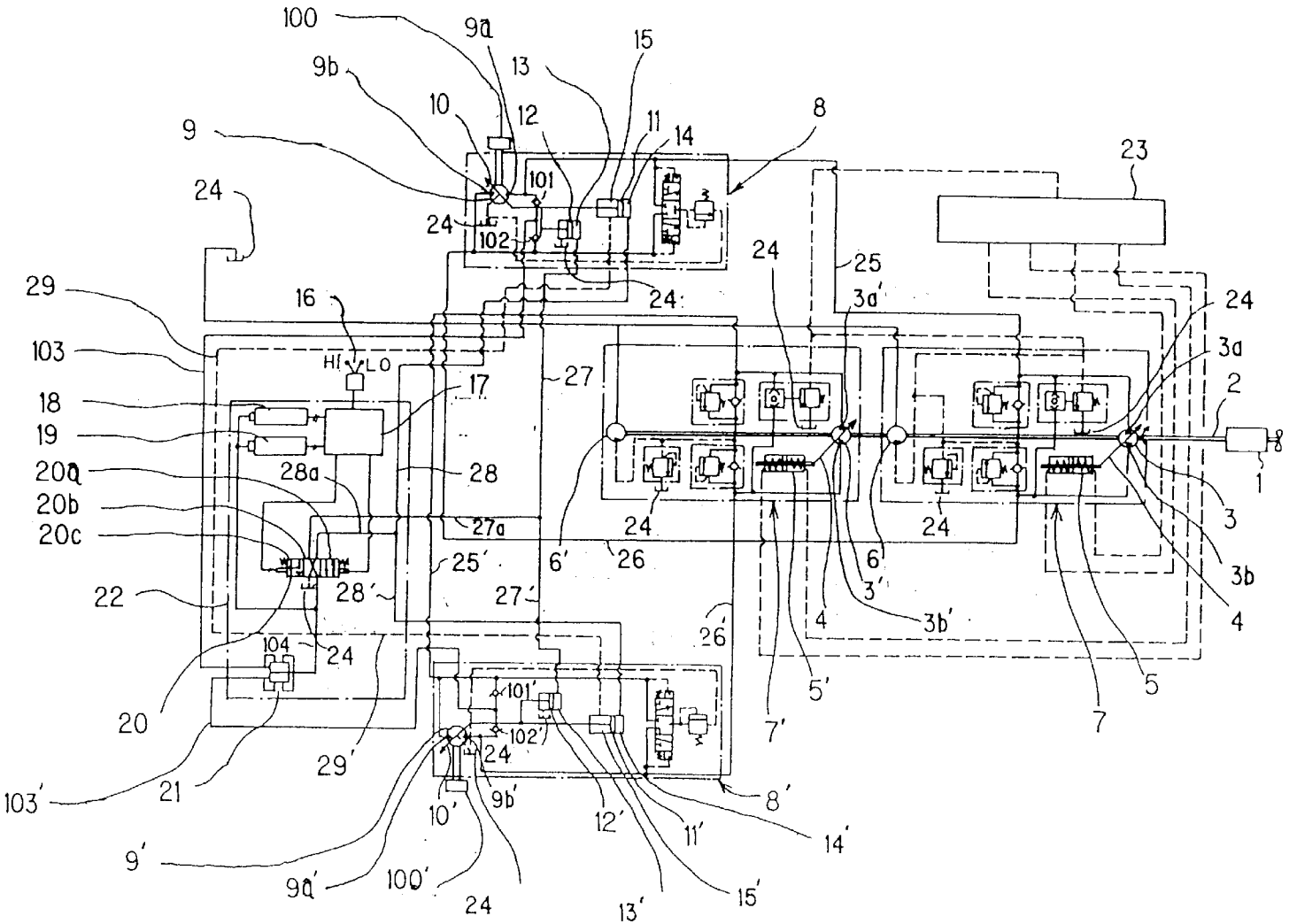
FIG. 13 is an oil hydraulic circuit chart of the present embodiment.

FIG. 13 is an oil hydraulic circuit chart of the HST vehicle in which the aforesaid hydraulic motor is installed.

In FIG. 13, like reference numerals are used for the like components as shown in FIG. 1 to FIG. 6 and FIG. 12, and their descriptions are omitted.

As shown in FIG. 13, running bodies 100, 100' of wheels or caterpillars are respectively mounted on left and right sides of the HST vehicle. This embodiment assumes the caterpillars as the running bodies. The left caterpillar 100 is driven to rotate by the hydraulic motor 9 described with reference to FIG. 4 to FIG. 6. Similarly, the right caterpillar 100' is driven to rotate by the hydraulic motor 9' similar to the hydraulic motor 9. In other words, the left and right caterpillars 100, 100' are rotating bodies which are driven to rotate by the left and right hydraulic motors 9, 9'.

A left motor mechanism 8 is mainly comprised of the left hydraulic motor 9. And, right motor mechanism 8' is mainly comprised of the right hydraulic motor 9'.

The left hydraulic motor 9 is driven by a left hydraulic pump 3 as a drive source. The right hydraulic motor 9' is driven by a right hydraulic pump 3' as a drive source. A left pump mechanism 7 is mainly comprised of the left hydraulic pump 3. And, a right pump mechanism 7' is mainly comprised of the right hydraulic pump 3'.

Specifically, the left-side caterpillar 100 of the vehicle body is independently driven and changed its speed by HST exclusive for the left side, namely a pair of the left pump mechanism 7 and the left motor mechanism 8. Similarly, the right-side caterpillar 100' of the vehicle body is independently driven and changed its speed by HST exclusive for the right side, namely a pair of the right pump mechanism 7' and the right motor mechanism 8'.

The HST vehicle is changed its speed by changing the capacities of the left and right hydraulic motors 9, 9'. The capacities of the left and right hydraulic motors 9, 9' are changed by a motor capacity switching mechanism 22.

Now, among the left motor mechanism 8, the right motor mechanism 8', the left pump mechanism 7 and the right pump mechanism 7', the left-side mechanism will be described as a representative example. A dash (') is added to the reference numerals for the component parts of the left-side mechanism to indicate the components of the right-side mechanism, and their descriptions will be omitted if not necessary.

The left hydraulic pump 3 is connected to a rotation shaft 2 as the output shaft of engine 1. In other words, the left hydraulic pump 3 is a variable displacement hydraulic pump driven by the engine 1. This hydraulic pump 3 is, for example, a swash plate type hydraulic pump. A swash plate 4 of the hydraulic pump 3 has a tilting angle which is variable depending on the moved position of a servo piston 5. The left hydraulic pump 3 has two discharge ports 3*a*, 3*b*. In other words, the left hydraulic pump 3 is a hydraulic pump which can flow the pressure oil in two directions. When the servo piston 5 changes its position and the tilting angle of the swash plate 4 is also changed, the discharge direction of the pressure oil is switched to the discharge port 3*a* or 3*b*, and the capacity of the left hydraulic pump 3 is changed accordingly.

A fixed displacement hydraulic pump 6 is connected to the rotation shaft 2 of the engine 1 and driven by the engine 1. The hydraulic pump 6 is a supply source for supplying the original pressure of a pilot pressure oil to a pilot valve 23. The servo piston 5 is supplied with the pilot pressure oil controlled by the pilot valve 23.

The discharge port 3*a* on one side of the left hydraulic pump 3 is communicated with a port 9*a* on one side of the left hydraulic motor 9 through a pipe 25. The discharge port 3*b* on the other side of the left hydraulic pump 3 is communicated with a port 9*b* on the other side of the left hydraulic motor 9 through a pipe 26.

Therefore, when the servo piston 5 is supplied with a pilot pressure oil from the pilot valve 23, the tilting angle of the swash plate 4 of the left hydraulic pump 3 is changed. Thus, the discharge port through which the pressure oil is discharged from the left hydraulic pump 3 is switched between 3*a* and 3*b*, and the pressure oil is flown into the port 9*a* or 9*b* of the left hydraulic motor 9.

When the pressure oil is flown into the port 9*a* of the left hydraulic motor 9, the left hydraulic motor 9 is rotated in one direction (called the normal direction), and the left caterpillar 100 is driven in the normal direction (called the forward direction). In this case, the pressure oil is flown from the port 9*b* on the opposite side of the port 9*a* of the left hydraulic motor 9 to the pipe 26 and circulated to the variable displacement hydraulic pump 3.

And, when the pressure oil is flown into the port 9*b* of the left hydraulic motor 9, the left hydraulic motor 9 is rotated in another direction (called the opposite direction), and the left caterpillar 100 is driven in the opposite direction (called the reverse direction). In this case, the pressure oil is flown from the port 9*a* on the opposite side of the port 9*b* of the left hydraulic motor 9 to the pipe 25 and circulated to the variable displacement hydraulic pump 3.

A right hydraulic pump 8' and the right hydraulic motor 9' also operate in the same way as described above.

Then, the structure of the motor capacity switching mechanism 22 will be described.

The motor capacity switching mechanism 22 comprises a three-position selector valve 20, a selector valve controller 17, pressure sensors 18, 19 and a high-pressure selecting valve 21.

The three-position selector valve 20 is supplied with an original pressure through a pipe 104.

Specifically, the left motor mechanism 8 is provided with check valves 101, 102. A pressure oil inlet port of the check valve 101 is connected to the pipe 25. A pressure oil inlet port of the check valve 102 is connected to the pipe 26. Pressure oil outlet ports of the check valves 101, 102 are connected to a pipe 103. The pipe 103 is connected to an inlet port of the high-pressure selection valve 21. Similarly, check valves 101 ', 102' are disposed on the right motor mechanism 8'. A pressure oil inlet port of the check valve 101' is connected to a pipe 25'. A pressure oil inlet port of the check valve 102' is connected to a pipe 26'. Pressure oil outlet ports of the check valves 101', 102' are connected to a pipe 103'. The pipe 103' is connected to an inlet port of the high-pressure selection valve 21. An outlet port of the high-pressure selection valve 21 is connected to a pipe 104.

Therefore, between a pressure of the pressure oil in the pipe 25 and a pressure of the pressure oil in the pipe 26, the pressure oil having a higher pressure is flown to the pipe 103 through the check valves 101, 102. And, between a pressure of the pressure oil in the pipe 25' and a pressure of the pressure oil in the pipe 26', the pressure oil having a higher pressure is flown to the pipe 103' through the check valves 101', 102'. In this embodiment, the two check valves 101, 102 or the check valves 101', 102' are used, but a shuttle valve may be used instead of the two check valves.

The high-pressure selection valve 21 selects the pressure oil having a higher pressure between a pressure of the pressure oil in the pipe 103 and a pressure of the pressure oil in the pipe 103' to flow to the pipe 104.

Figure 14:
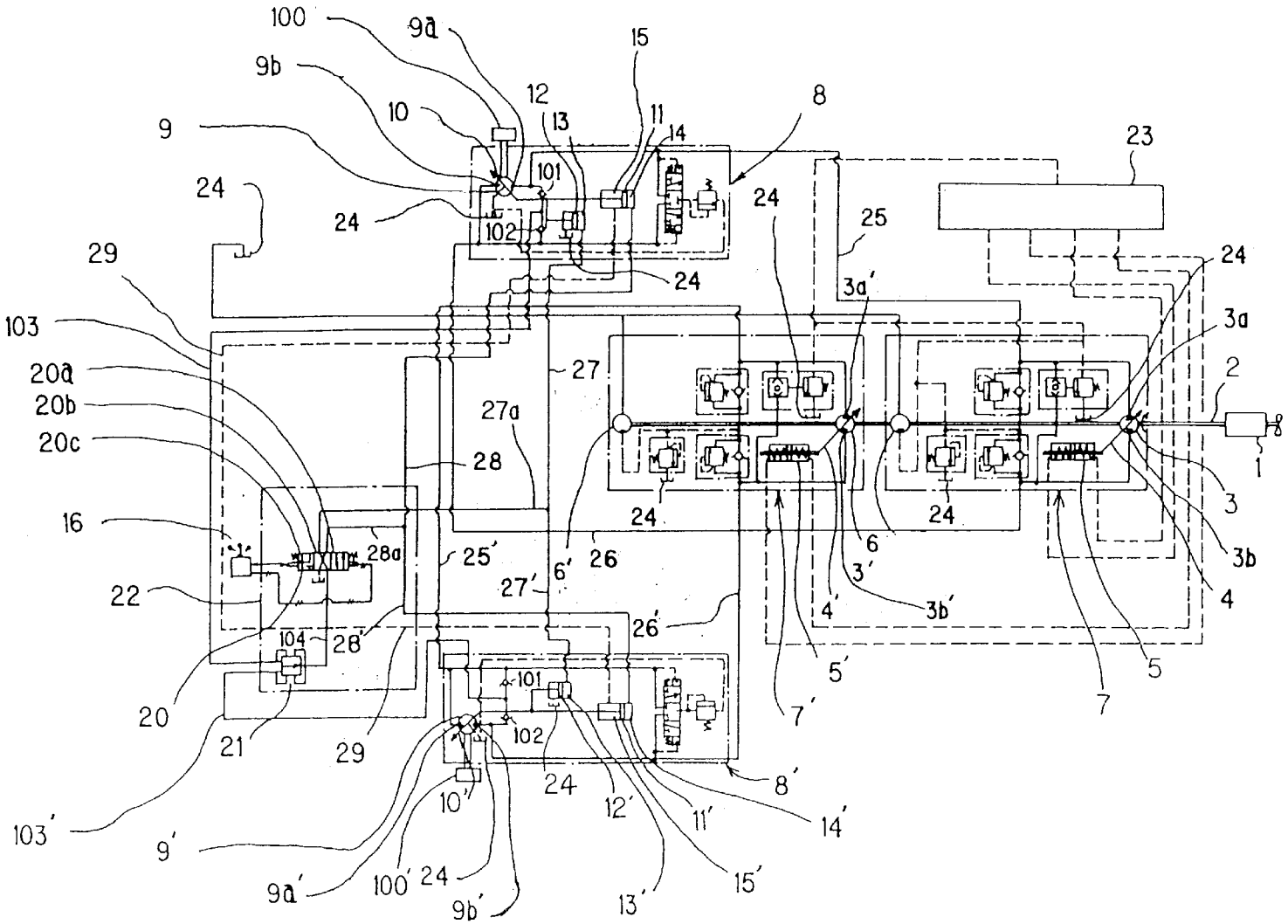
FIG. 14 is an oil hydraulic circuit chart of another embodiment different from FIG. 13.

Thus, the pressure oil having a higher pressure between the pressure oils flown into the left and right hydraulic motors 9, 9' is supplied as the original pressure to a 3-position selector valve 20 (FIG. 13 and FIG. 14).

As described above, in the embodiment illustrated, the pressure oil selected by the high-pressure selection valve 21 acts on the left and right motor mechanisms 8, 8' through the single 3-position selector valve 20.

Here, an oil hydraulic circuit for operating the left and right motor mechanisms 8, 8' may be configured as follows. The pressure oil in the pipe 103 drives only the left motor mechanism 8 through a single 3-position selector valve, and the pressure oil in the pipe 103' drives only the right motor mechanism 8' through another 3-position selector valve. In this case, the two 3-position selector valves are simultaneously controlled by the selector valve controller 17 by switching the selector switch 16.

The pressure oil (original pressure of the 3-position selector valve) in the pipe 104 is detected by the pressure sensors 18, 19 disposed on the pipe 104. The pressure sensor 18 is a sensor which detects that a pressure of the pressure oil in the pipe 104 becomes a first threshold or higher. The pressure sensor 19 is a sensor which detects that a pressure of the pressure oil in the pipe 104 has a second threshold or higher. Here, the second threshold is greater than the first threshold.

Detection signals output from the pressure sensors 18, 19 are entered the selector valve controller 17.

The 3-position selector valve 20 has three valve positions, namely a maximum position 20*a*, a middle position 20*b* and a minimum position 20*c*. Pipes 27*a*, 28*a* are connected to the 3-position selector valve 20. The pipe 27*a* is branched to left and right pipes 27, 27'. The pipe 27 is communicated with first pressure-receiving chamber 13 of the left motor mechanism 8. Similarly, the pipe 27' is communicated with a first pressure-receiving chamber 13' of the right motor mechanism 8'. The pipe 28*a* is branched to left and right pipes 28, 28'. The pipe 28 is communicated with a second pressure-receiving chamber 14 of the left motor mechanism 8. Similarly, the pipe 28' is communicated with a second pressure-receiving chamber 14' of the right motor mechanism 8'.

The pipe 104 is branched to left and right pilot pipes 29, 29'. The pipe 29 is communicated with a third pressure-receiving chamber 15 of the left motor mechanism 8. Similarly, the pipe 29' is communicated with a third pressure-receiving chamber 15' of the right motor mechanism 8'. Therefore, the respective pressure-receiving chambers 13 to 15 and 13' to 15' of the left and right motor mechanisms 8, 8' are supplied with a signal pressure having the higher pressure as the original pressure between the pressure oils flown into the left and right hydraulic motors 9, 9'.

Therefore, when the valve position of the 3-position selector valve 20 is switched to the maximum position 20*a*, the capacities of the hydraulic motors 9, 9' are positioned at the maximum capacity position. When the valve position of the 3position selector valve 20 is switched to the middle position 20*b*, the capacities of the hydraulic motors 9, 9' are positioned at the middle capacity position. And, when the valve position of the 3-position selector valve 20 is switched to the minimum position 20*c*, the capacities of the hydraulic motors 9, 9' are positioned at the minimum capacity position.

Switching of the 3-position selector valve 20 is controlled by the selector valve controller 17. A control signal output from the selector valve controller 17 is applied to the electromagnetic solenoid of the 3-position selector valve 20, and the valve position of the 3-position selector valve 20 is switched (the circuit chart of FIG. 13). The control signal output from the selector valve controller 17 may be used as a hydraulic pilot pressure instead of an electric current to act on the 3-position selector valve 20 so to switch the valve position of the 3-position selector valve 20.

The selector valve controller 17 is provided with selector switch 16 which is manually operated to change the speed of the left and right hydraulic motors 9, 9'. When the selector switch 16 is switched to "Lo" side, a Lo signal for changing the left and right hydraulic motors 9, 9' to the low rotations is entered the selector valve controller 17. And, when the selector switch 16 is switched to "Hi" side, a Hi signal for changing the left and right hydraulic motors 9, 9' to the high rotations is entered the selector valve controller 17.

Now, the contents of control made by the selector valve controller 17 will be described with reference to FIG. 15. Operation of the left hydraulic motor 9 will be typically described below.

FIG. 15(*b*) is a diagram showing relations among ON/OFF of the supply of pressure oil to the first, second and third pressure-receiving chambers 13, 14, 15, the capacity of the hydraulic motor and the switching condition of the selector switch 16. In the drawing, "ON" indicates that the pressure oil of a high pressure is being supplied to the pressure-receiving chamber, and "OFF" indicates that the pressure oil of a low pressure is being supplied to the pressure-receiving chamber. The low pressure condition is, for example, a state that the supply of the pressure is stopped. In the following description, a magnitude of the "high pressure" is P and a magnitude of the "low pressure" is 0 (gage pressure) for convenience of description. In the drawing, the combination (Max., OFF, ON, ON) in the first columns corresponds to the combination in the fifth heavy-lined columns of FIG. 7. The combination (Intermediate, ON, OFF, ON) in the second columns correspond to the combination in the third heavy-lined columns of FIG. 7. The combination (Minimum, OFF, OFF, ON) in the third columns corresponds to the seventh heavy-lined columns in FIG. 7.

When the selector switch 16 is switched to "Lo", a Lo signal for changing the speed of the left hydraulic motor 9 to the low rotation is entered the selector valve controller 17. Then, the selector valve controller 17 applies a control signal for switching the valve position of the 3-position selector valve 20 to the maximum position 20*a* to the electromagnetic solenoid of the 3-position selector valve 20. Thus, the valve position of the 3-position selector valve 20 is switched to the maximum position 20*a*.

Therefore, the pressure oil of high pressure P is supplied to the second pressure-receiving chamber 14 from the 3-position selector valve 20 through the pipes 28*a*, 28. And, the pressure oil of high pressure P is supplied to the third pressure-receiving chamber 15 through the pipe 104 and the pilot pipe 29. The first pressure-receiving chamber 13 is communicated with tank 24 through the pipes 27, 27*a* and the 3-position selector valve 20, and the pressure oil in the first pressure-receiving chamber 13 is in a low pressure state.

As a result, the first piston 11 and the second piston 12 are in a state positioned at the maximum capacity position shown in FIG. 4. At this point, a center shaft 10 of the left hydraulic motor 9 is changed to have an angle corresponding to the maximum capacity position.

Similarly, a center shaft 10' of the right hydraulic motor 9' is changed to have an angle corresponding to the maximum capacity position.

Thus, the capacity positions of the left and right hydraulic motors 9, 9' are switched to the maximum capacity position, and the left and right hydraulic motors 9, 9' are changed their speeds to the first speed of a low rotation speed with high torque. The left and right caterpillars 100, 100' are changed their rotation speeds to the minimum rotation speed.

At this time, the left and right hydraulic motors 9, 9' are adjusted to have the same maximum capacity position by the maximum capacity adjusting mechanism 53 shown in FIG. 4. Thus, the left and right caterpillars 100, 100' are controlled to have the same rotation speed.

When the selector switch 16 is switched to "Hi", a Hi signal for changing the speed of the left hydraulic motor 9 to the high rotation is entered the selector valve controller 17. Then, the selector valve controller 17 applies to the electromagnetic solenoid of the 3-position selector valve 20 a control signal for switching the valve position of the 3-position selector valve 20 to the middle position 20*b* or the minimum position 20*c* according to the detection signals of the pressure sensors 18, 19. Thus, the valve position of the 3-position selector valve 20 is changed to the middle position 20*b* or the minimum position 20*c*.

The selector valve controller 17 has a timer therein to count that the pressure oil in the pipe 104 has a pressure of the aforesaid second threshold or higher continuously for one second or more according to the pressure sensor 19 or the pressure oil in the pipe 104 has a pressure of the aforesaid first threshold or below continuously for one second or more according to the pressure sensor 18.

When it is counted by the aforesaid timer that the pressure oil in the pipe 104 has a pressure of the aforesaid second threshold or higher continuously for one second or more, a control signal for switching to the middle position 20*b* is applied from the selector valve controller 17 to the electromagnetic solenoid of the 3-position selector valve 20. Thus, the valve position of the 3-position selector valve 20 is switched to the middle position 20*b*.

Therefore, the pressure oil of high pressure P is supplied from the 3-position selector valve 20 to the first pressure-receiving chamber 13 through the pipes 27*a*, 27. The pressure oil of high pressure P is supplied to the third pressure-receiving chamber 15 through the pipe 104 and the pilot pipe 29. The second pressure-receiving chamber 14 is communicated with the tank 24 through the pipes 28, 28*a* and the 3-position selector valve 20, and the pressure oil in the second pressure-receiving chamber 14 has a low pressure.

As a result, the first piston 11 and the second piston 12 are in a state positioned at the middle capacity position shown in FIG. 5. At this point, the center shaft 10 of the left hydraulic motor 9 is changed to have an angle corresponding to the middle capacity position.

Similarly, the center shaft 10' of the right hydraulic motor 9' is changed to have an angle corresponding to the middle capacity position.

Thus, the capacity positions of the left and right hydraulic motors 9, 9' are changed to the middle capacity position, and the left and right hydraulic motors 9, 9' are changed their speeds to the second speed at the middle rotation speed with intermediate torque. The rotation speeds of the left and right caterpillars 100, 100' are changed to the middle rotation speed.

At this point, the left and right hydraulic motors 9, 9' are adjusted to have the same middle capacity position by the middle position adjusting mechanism 40 shown in FIG. 5. Thus, the left and right caterpillars 100, 100' can be adjusted to have the same rotation speed.

When it is counted by the aforesaid timer that the pressure oil in the pipe 104 has a pressure of the aforesaid first threshold or below continuously for one second or more, a control signal for switching to the minimum position 20*c* is applied from the selector valve controller 17 to the electromagnetic solenoid of the 3-position selector valve 20. Thus, the valve position of the 3-position selector valve 20 is switched to the minimum position 20*c*.

Therefore, the pressure oil of high pressure P is supplied to the third pressure-receiving chamber 15 through the pipe 104 and the pilot pipe 29. The first pressure-receiving chamber 13 is communicated with the tank 24 through the pipes 27, 27*a* and the 3-position selector valve 20, and the hydraulic oil in the first pressure-receiving chamber 13 is in a low pressure state. The second pressure-receiving chamber 14 is communicated with the tank 24 through the pipes 28, 28*a* and the 3-position selector valve 20, and the pressure oil in the second pressure-receiving chamber 14 is in a low pressure state.

As a result, the first piston 11 and the second piston 12 are positioned at the minimum capacity position shown in FIG. 6. At this point, the center shaft 10 of the left hydraulic motor 9 is changed to have an angle corresponding to the minimum capacity position.

Similarly, the center shaft 10' of the right hydraulic motor 9' is changed to have an angle corresponding to the minimum capacity position.

Thus, the capacity positions of the left and right hydraulic motors 9, 9' are changed to the minimum capacity position, and the left and right hydraulic motors 9, 9' are changed their speeds to the third speed at a high rotation speed with low torque. The left and right caterpillars 100, 100' are changed their rotation speeds to the maximum rotation speed.

At this point, the left and right hydraulic motors 9, 9' are adjusted to have the same minimum capacity position by the minimum capacity adjusting mechanism 54 shown in FIG. 6. Thus, the left and right caterpillars 100, 100' can be adjusted to have the same rotation speed.

As described above, when the hydraulic motors 9, 9' are used to change the rotation speeds of the left and right caterpillars 100, 100' among three levels in this embodiment, a difference in the number of rotations between the left and right caterpillars 100, 100' can be eliminated to prevent a deviation from the course.

And, according to this embodiment, the capacity positions of the left and right hydraulic motors 9, 9' are changed among the three levels, so that the capacities of the left and right hydraulic pumps 3, 3' can be made small, and the hydraulic pumps 3, 3' can be made compact in size. Therefore, the cost of the hydraulic equipment can be reduced, and the hydraulic equipment can be installed in a limited space. Because the hydraulic pumps 3, 3' and the hydraulic motors 9, 9' can be used under the pressure and capacity conditions good for their efficiency, the performance of the HST vehicle can be improved.

Figure 11A:
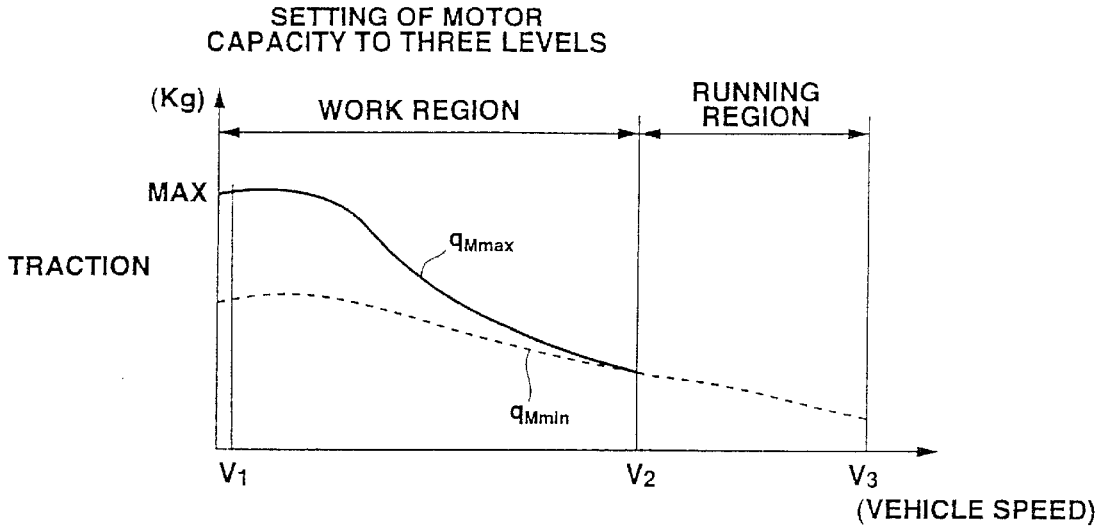
FIGS. 11(*a*) and 11(*b*) are diagrams showing comparison between a two-stage change and a three-stage change of the capacity of a hydraulic motor.
Figure 11B:
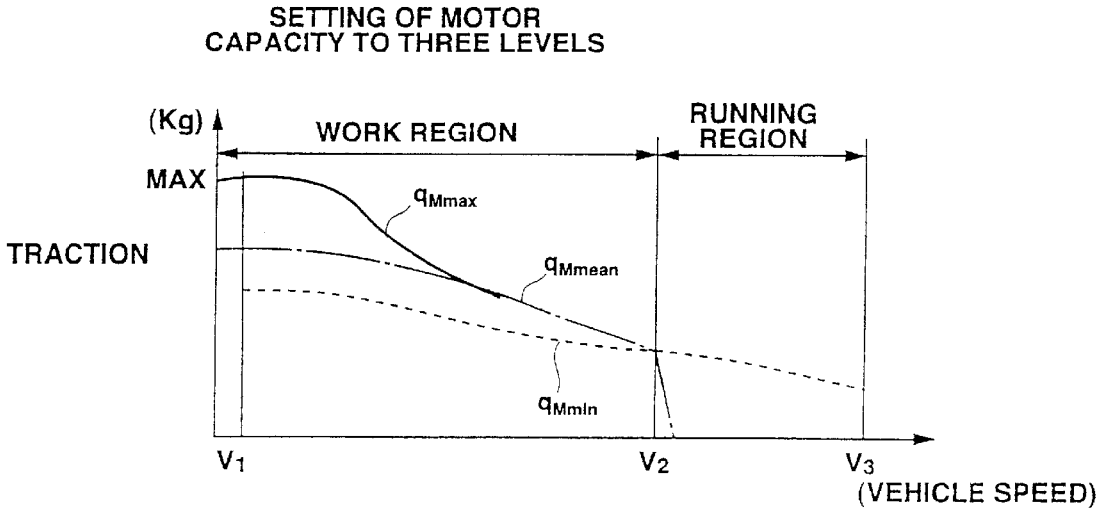

And, according to this embodiment, when the selector switch 16 is switched to Hi, switching between the second speed and the third speed can be made automatically. A range between the second speed and the third speed is a running range at a high rotation speed with low torque as shown in FIG. 11(*b*). According to this embodiment, the manual speed change in the running region requiring the rotation speed is not necessary, and the operability in the running region can be improved.

Besides, this embodiment provides the following effects.

Specifically, when it is assumed that a difference in rotations of the left and right hydraulic motors 9, 9' is ΔNm, time required to change the speed is Δt, a difference in running length of the left and right caterpillars 100, 100' is ΔL, and a constant defined according to the structures of the left and right caterpillars 100, 100' is D, the following relation is established among them.

$$D \cdot \Delta Nm \cdot \Delta t = \Delta L \quad (3)$$

To prevent a deviation from the course of the vehicle in the automatic speed change, it is necessary to decrease Δt, and the capacities of the hydraulic motors 9, 9' during the automatic speed change must be changed in a short duration.

When the capacities of the hydraulic motors 9, 9' are changed quickly, a motor flow-in pressure in the left pipes 25, 26 and a motor flow-in pressure in the right pipes 25', 26' vary largely, resulting in likely occurring hunting in controlling. According to this embodiment, when it is counted that the pressure of the pressure oil in the pipe 104 has the second threshold or more continuously for one second or more or the pressure of the pressure oil in the pipe 104 is the aforesaid first threshold or below continuously for one second or more, the speed is changed to the second speed or the third speed. Therefore, even when the capacities of the left and right hydraulic motors 9, 9' are changed in a short duration, the motor flow-in pressure in the left pipes 25, 26 and the motor flow-in pressure in the right pipes 25', 26' are prevented from varying to suppress hunting in controlling.

In this embodiment, when the switch 16 is operated to the Hi side, the automatic speed change is performed between the second speed and the third speed. But, it may be designed to perform the automatic speed change between the first speed and the second speed by operating the operation switch 16 to the Lo side as described below.

FIG. 15(*c*) is a diagram corresponding to FIG. 15(*b*) of this embodiment.

When the selector switch 16 is switched to the "Lo" side, a Lo signal for changing the speed of the left hydraulic motor 9 to the low rotations is entered the selector valve controller 17. Therefore, the selector valve controller 17 applies to the electromagnetic solenoid of the 3-position selector valve 20 a control signal for switching the valve position of the 3-position selector valve 20 to the maximum position 20*a* or the middle position 20*b* according to the detection signals of the pressure sensors 18, 19. Thus, the valve position of the 3-position selector valve 20 is switched to the maximum position 20*a* or the middle position 20*b*.

When it is counted by the aforesaid timer that the pressure of the pressure oil in the pipe 104 is the aforesaid second threshold or more continuously for one second or more, a control signal for switching to the maximum position 20*a* is applied from the selector valve controller 17 to the electromagnetic solenoid of the 3-position selector valve 20. Thus, the valve position of the 3-position selector valve 20 is switched to the maximum position 20*a*.

Therefore, the pressure oil of high pressure P is supplied from the 3-position selector valve 20 to the second pressure-receiving chamber 14 through the pipes 28*a*, 28. And, the pressure oil of high pressure P is supplied to the third pressure-receiving chamber 15 through the pipe 104 and the pilot pipe 29. The first pressure-receiving chamber 13 is communicated with the tank 24 through the pipes 27, 27*a* and the 3-position selector valve 20, and the pressure oil in the first pressure-receiving chamber 13 is in a low pressure state.

As a result, the first piston 11 and the second piston 12 have a state positioned at the maximum capacity position shown in FIG. 4. At this point, the center shaft 10 of the left hydraulic motor 9 is changed to have an angle corresponding to the maximum capacity position.

Similarly, the center shaft 10' of the right hydraulic motor 9' is changed to have an angle corresponding to the maximum capacity position.

Thus, the capacity positions of the left and right hydraulic motors 9, 9' are changed to the maximum capacity position, and the left and right hydraulic motors 9, 9' are changed their speeds to have the first speed at a low rotation speed with high torque. The rotation speeds of the left and right caterpillars 100, 100' are changed to the minimum rotation speed.

At this point, the left and right hydraulic motors 9, 9' are adjusted to have the same maximum capacity position by the maximum capacity adjusting mechanism 53 shown in FIG. 4. Thus, the left and right caterpillars 100, 100' are made to have the same rotation speed.

When it is counted by the aforesaid timer that the pressure of the pressure oil in the pipe 104 is the aforesaid threshold or below continuously for one second or more, a control signal for switching to the middle position 20*b* is applied from the selector valve controller 17 to the electromagnetic solenoid of the 3-position selector valve 20. Thus, the valve position of the 3-position selector valve 20 is switched to the middle position 20*b*.

Therefore, the pressure oil of high pressure P is supplied from the 3-position selector valve 20 to the first pressure-receiving chamber 13 through the pipes 27*a*, 27. And, the pressure oil of high pressure P is supplied to the third pressure-receiving chamber 15 through the pipe 104 and the pilot pipe 29. The second pressure-receiving chamber 14 is communicated with the tank 24 through the pipes 28, 28*a* and the 3-position selector valve 20, and the pressure of the pressure oil in the second pressure-receiving chamber 14 is in a low pressure state.

As a result, the first piston 11 and the second piston 12 are in a state positioned at the middle capacity position as shown in FIG. 5. At this point, the center shaft 10 of the left hydraulic motor 9 is changed to have an angle corresponding to the middle capacity position.

Similarly, the center shaft 10' of the right hydraulic motor 9' is changed to have an angle corresponding to the middle capacity position.

Thus, the capacity positions of the left and right hydraulic motors 9, 9' are switched to the middle capacity positions, and the left and right hydraulic motors 9, 9' are changed to have the second speed at the middle rotation speed with intermediate torque. The rotation speeds of the left and right caterpillars 100, 100' are changed to the middle rotation speed.

At this point, the left and right hydraulic motors 9, 9' are adjusted to have the same middle capacity position by the middle position adjusting mechanism 40 shown in FIG. 5. Thus, the left and right caterpillars 100, 100' can be made to have the same rotation speed.

When the selector switch 16 is switched to the "Hi" side, a Hi signal for changing the left hydraulic motor 9 to the high rotation is entered the selector valve controller 17. Therefore, the selector valve controller 17 applies to the electromagnetic solenoid of the 3-position selector valve 20 a control signal for switching the valve position of the 3-position selector valve 20 to the minimum position 20*c*. Thus, the valve position of the 3-position selector valve 20 is switched to the minimum position 20*c*.

Therefore, the pressure oil of high pressure P is supplied to the third pressure-receiving chamber 15 through the pipe 104 and the pilot pipe 29. The first pressure-receiving chamber 13 is communicated with the tank 24 through the pipes 27, 27*a* and the 3-position selector valve 20, and the pressure oil in the first pressure-receiving chamber 13 is in a low pressure state. The second pressure-receiving chamber 14 is communicated with the tank 24 through the pipes 28, 28*a* and the 3-position selector valve 20, and the pressure oil in the second pressure-receiving chamber 14 is in a low pressure state.

As a result, the first piston 11 and the second piston 12 are in a state positioned at the minimum capacity position shown in FIG. 6. At this point, the center shaft 10 of the left hydraulic motor 9 is changed to have an angle corresponding to the minimum capacity position.

Similarly, the center shaft 10' of the right hydraulic motor 9' is changed to have an angle corresponding to the minimum capacity position.

Thus, the capacity positions of the left and right hydraulic motors 9, 9' are switched to the minimum capacity position, and the left and right hydraulic motors 9, 9' are changed their speeds to have the third speed at a high rotation speed with low torque. The rotation speeds of the left and right caterpillars 100, 100' are changed to the maximum rotation speed.

At this point, the left and right hydraulic motors 9, 9' are adjusted to have the same minimum capacity position by the minimum capacity adjusting mechanism 54 shown in FIG. 6. Thus, the left and right caterpillars 100, 100' can be made to have the same rotation speed.

According to this embodiment, when the selector switch 16 is operated toward the Lo side, switching between the first speed and the second speed is performed automatically. A range between the first speed and the second speed is a work range of a low rotation speed with high torque as shown in FIG. 11(*b*). According to this embodiment, the manual speed change in the work range requiring torque can be eliminated, and operability in the work range can be improved.

In the aforesaid embodiment, when the operation switch 16 is operated toward the Hi side, the automatic speed change is performed between the second speed and the third speed, and when the operation switch 16 is operated toward the Lo side, the automatic speed change is performed between the first speed and the second speed. But, a switch or the like may be used to select the automatic switching between the first rotation speed and the second rotation speed or the automatic switching between the second rotation speed and the third rotation speed. The range between the first rotation speed and the second rotation speed is a work region of a low rotation speed with high torque. According to this embodiment, when the automatic speed change in the work region is selected depending on a use condition of the hydraulic motors 9, 9', operability in the running region is improved, and the speed change in the running region is freely performed manually. When the automatic speed change in the running region is selected depending on a use condition of the hydraulic motors 9, 9', operability in the running region is improved, and the speed change in the work region is freely performed manually.

The speed change among the first speed, the second speed and the third speed may be made manually.

FIG. 14 is an oil hydraulic circuit chart related to the manual speed change among the first speed, the second speed and the third speed. In FIG. 14, like reference numerals are used to indicate the like components of FIG. 13 and their descriptions are omitted. Differences from FIG. 13 will be described below.

Motor capacity switching mechanism 22 of FIG. 14 is different from the one shown in FIG. 13 and not provided with the selector valve controller 17. The 3-position selector valve 20 is provided with selector switch 16 for manual speed change of left and right hydraulic motors 9, 9'. When the selector switch 16 is switched to "Lo", a Lo signal for the speed change of the left and right hydraulic motors 9, 9' to the first speed is entered the electromagnetic solenoid of the 3-position selector valve 20. When the selector switch 16 is switched to "Mid", a Mid signal for changing the speeds of the left and right hydraulic motors 9, 9' to the second speed is entered the electromagnetic solenoid of the 3-position selector valve 20. When the selector switch 16 is switched to "Hi", a Hi signal. for changing the speeds of the left and right hydraulic motors 9, 9' is entered the electromagnetic solenoid of the 3-position selector valve 20.

FIG. 15(*a*) is a diagram corresponding to FIGS. 15(*b*), (*c*) of this embodiment.

When the selector switch 16 is switched to "Lo", a Lo signal for changing the speeds of the left and right hydraulic motors 9, 9' to the first speed is entered the electromagnetic solenoid of the 3-position selector valve 20. Therefore, the valve position of the 3-position selector valve 20 is switched to maximum position 20*a*, and pressure oils of low pressure (OFF), high pressure (ON) and high pressure (ON) are supplied to first, second and third pressure-receiving chambers of the left and right motor mechanisms 8, 8'. Thus, the left and right hydraulic motors 9, 9' have a state positioned at the maximum capacity position shown in FIG. 4. At this point, center shafts 10, 10' of the left and right hydraulic motors 9, 9' are changed to have an angle corresponding to the maximum capacity position.

Thus, the capacity positions of the left and right hydraulic motors 9, 9' are switched to the maximum capacity position, and the left and right hydraulic motors 9, 9' are changed to have the first speed at a low rotation speed with high torque. The rotation speeds of left and right caterpillars 100, 100' are switched to the minimum rotation speed.

At this point, the left and right hydraulic motors 9, 9' are adjusted to have the same maximum capacity position by the maximum capacity adjusting mechanism 53 shown in FIG. 4. Thus, the left and right caterpillars 100, 100' can be adjusted to have the same rotation speed.

When the selector switch 16 is switched to "Mid", a Mid signal for the speed change of the left and right hydraulic motors 9, 9' to the second speed is entered the electromagnetic solenoid of the 3-position selector valve 20. Therefore, the valve position of the 3-position selector valve 20 is switched to middle position 20*b*, and the pressure oils of high pressure (ON), low pressure (OFF) and high pressure (ON) shown in FIG. 15(*a*) are supplied to the first, second and third pressure-receiving chambers of the left and right motor mechanisms 8, 8'. Thus, the left and right hydraulic motors 9, 9' have a state positioned at the middle capacity position shown in FIG. 5. At this point, the center shafts 10, 10' of the left and right hydraulic motors 9, 9' are changed to have an angle corresponding to the middle capacity position.

Thus, the capacity positions of the left and right hydraulic motors 9, 9' are switched to the middle capacity position, and the left and right hydraulic motors 9, 9' are changed their speeds to the second speed at a middle rotation speed with middle torque. The left and right caterpillars 100, 100' are changed their rotation speeds to the middle rotation speed.

At this point, the left and right hydraulic motors 9, 9' are adjusted to have the same middle capacity position by the middle position adjusting mechanism 40 shown in FIG. 5. Thus, the left and right caterpillars 100, 100' can be adjusted to have the same rotation speed.

When the selector switch 16 is switched to "Hi", a Hi signal for changing the speeds of the left and right hydraulic motors 9, 9' to the third speed is entered the electromagnetic solenoid of the 3-position selector valve 20. Therefore, the valve position of the 3-position selector valve 20 is switched to minimum position 20*c*, and the pressure oils of low pressure (OFF), low pressure (OFF) and high pressure (ON) shown in FIG. 15(*a*) are supplied to the first, second and third pressure-receiving chambers of the left and right motor mechanisms 8, 8'. Thus, the left and right hydraulic motors 9, 9' have a state positioned at the minimum capacity position shown in FIG. 6. At this point, the center shafts 10, 10' of the left and right hydraulic motors 9, 9' are changed to have an angle corresponding to the minimum capacity position.

Thus, the capacity positions of the left and right hydraulic motors 9, 9' are switched to the minimum capacity position, and the left and right hydraulic motors 9, 9' are changed their speeds to have the third speed at the high rotation speed with low torque. The rotation speeds of the left and right caterpillars 100, 100' are switched to the maximum rotation speed.

At this point, the left and right hydraulic motors 9, 9' are adjusted to have the same minimum capacity position by the minimum capacity adjusting mechanism 54 shown in FIG. 6. Thus, the left and right caterpillars 100, 100' can be adjusted to have the same rotation speed.

According to this embodiment, switching among the first rotation speed, the second rotation speed and the third rotation speed is manually performed by the selector switch 16. When the automatic switching of the capacities of the hydraulic motors 9, 9' is not desirable, the switching can be made manually as desired.

In this embodiment, the automatic speed change is performed between the first speed and the second speed or between the second speed and the third speed. But, the automatic speed change may be performed among the first speed, the second speed and the third speed.

In this embodiment, the automatic speed change is performed according to the detection signals of the pressure sensors 18, 19. But, the invention is not limited to the above, and a load on the left and right hydraulic motors 9, 9' may be detected by predetermined means to perform the automatic speed change according to the detected load.

The automatic speed change may be made according to the number of revolutions of engine 1. And, the automatic speed change may also be performed according to the number of rotations of the left and right hydraulic motors 9, 9'.

In this embodiment, the left and right hydraulic motors 9, 9' are provided with the hydraulic pumps 3, 3' respectively. But, a common hydraulic pump may be mounted for the left and right hydraulic motors 9, 9' to supply the pressure oil discharged from the hydraulic pump to the left and right hydraulic motors 9, 9'.

This embodiment assumes a running/shifting device for vehicles which changes a speed by driving to rotate the left and right running bodies 100, 100' by the left and right hydraulic motors 9, 9'. But, the invention is not limited to the above and may be applied to any device if the speed is changed by driving to rotate the left and right rotating bodies by the left and right hydraulic motors 9, 9'.

For example, the invention can also be applied to a conveying device which changes its speed by driving to rotate the left and right rotating bodies by the left and right hydraulic motors.

Then, a positioning device for positioning at four positions, namely the maximum position, the first middle position, the second middle position and the minimum position, will be described with reference to FIG. 16.

Figure 16:
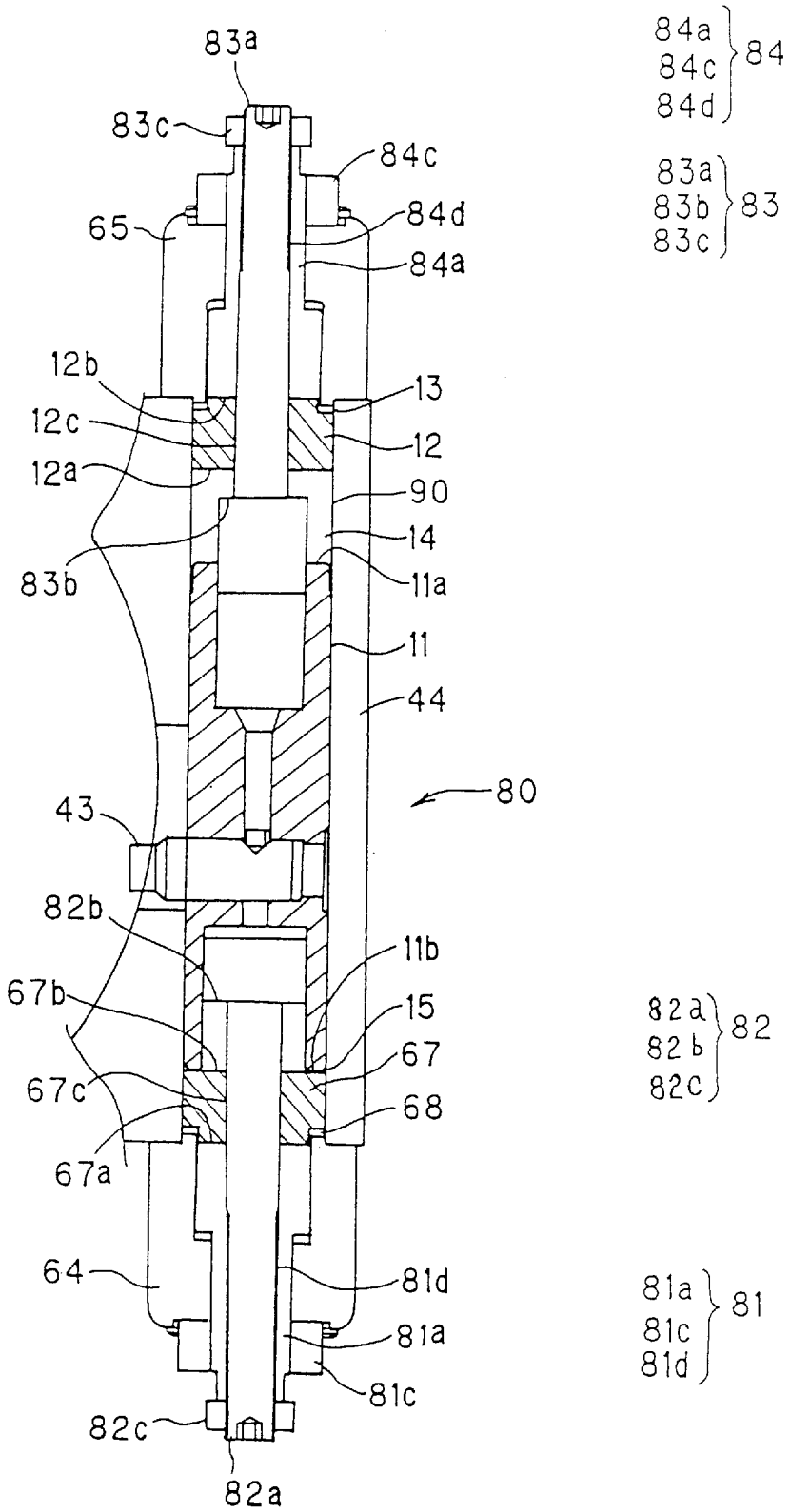
FIG. 16 is a sectional diagram showing a positioning device which can make positioning at four positions.
Figure 17A:
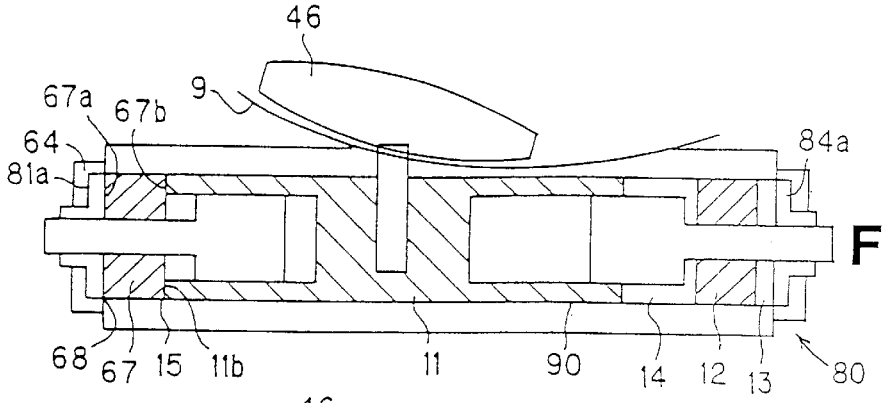
FIG. 17(*a*) is a diagram showing a maximum capacity state, FIG. 17(*b*) is a diagram showing a first medium capacity state, FIG. 17(*c*) is a diagram showing a second medium capacity state, and FIG. 17(*d*) is a diagram showing a minimum capacity state.
Figure 17B:
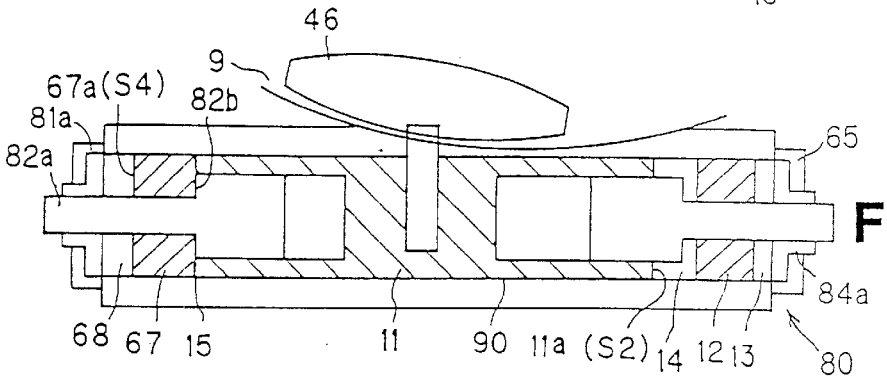
Figure 17C:
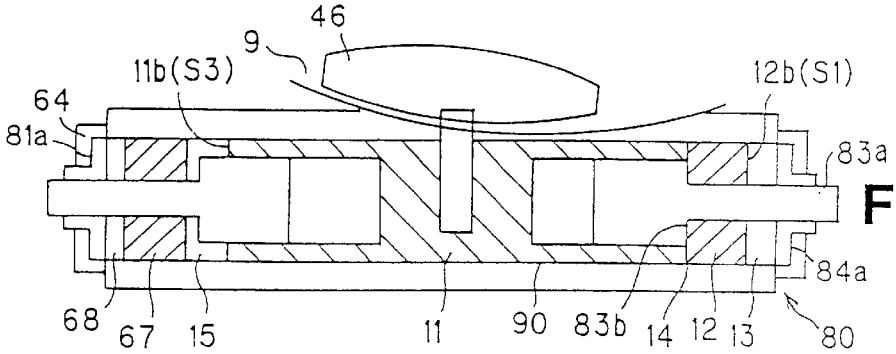
Figure 17D:
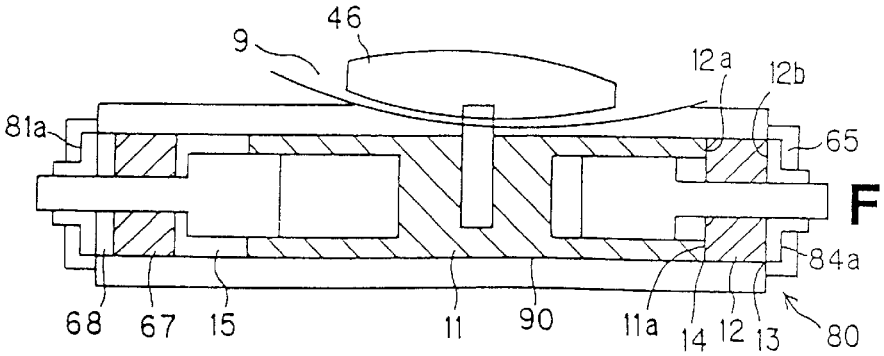

FIG. 16 is a sectional diagram of positioning device 80 for fixing at the four positions. Like portions of the embodiment shown in FIG. 1 to FIG. 3 will not be described if not necessary.

Differences between the positioning device 80 shown in FIG. 16 and the positioning device 45 shown in FIG. 1 to FIG. 3 are as follows. Specifically, a third piston 67 is disposed in addition to the first piston 11 and the second piston 12. A maximum position adjusting mechanism 81 and a minimum position adjusting mechanism 84 are also disposed along the moving direction of the first piston 11, the second piston 12 and the third piston 67. A first middle position adjusting mechanism 82 is fitted to the maximum position adjusting mechanism 81, and a second middle position adjusting mechanism 83 is fitted to the minimum position adjusting mechanism 84. Such differences will be mainly described below.

A hole 90 is formed in a body 44. In the hole 90 of the body 44, the first piston 11 and the second piston 12 are disposed with end faces 11*a*, 12*a* opposed to each other. The third piston 67 is also disposed in the hole 90 of the body 44 with an end face 67*b* opposed to the end face 11*b* of the first piston 11. A cover 65 is disposed on the body 44 so to be opposite to the end face 12*b* of the second piston 12. A cover 64 is disposed on the body 44 so to be opposite to an end face 67*a* of the third piston 67.

The maximum position adjusting mechanism 81 is fitted to the cover 64. The minimum position adjusting mechanism 84 is fitted to the cover 65. The first middle position adjusting mechanism 82 is fitted to the maximum position adjusting mechanism 81. The minimum position adjusting mechanism 84 is fitted to the cover 65. The second middle position adjusting mechanism 83 is fitted to the minimum position adjusting mechanism 84. The minimum position adjusting mechanism 84 has the same structure as the maximum position adjusting mechanism 81 does. The second middle position adjusting mechanism 83 has the same structure as the first middle position adjusting mechanism 82 does. Therefore, the structures of the maximum position adjusting mechanism 81 and the first middle position adjusting mechanism 82 will be described, while those of the minimum position adjusting mechanism 84 and the second middle position adjusting mechanism 83 will not be described.

Specifically, the maximum position adjusting mechanism 81 comprises an adjusting screw 81*a* and a nut 81*c*. The adjusting screw 81*a* is fixed to the cover 64 by the nut 81*c*. The adjusting screw 81*a* is installed on the same axis as the third piston 67. Therefore, the adjusting screw 81*a* can be relatively moved to the cover 64.

The minimum position adjusting mechanism 84 also has the same structure as the maximum position adjusting mechanism 81 does. Therefore, the adjusting screw 84*a* can be relatively moved to the cover 65.

The first middle position adjusting mechanism 82 comprises an adjusting screw 82*a* and a nut 82*c*. The adjusting screw 82*a* is fixed to the adjusting screw 81*a* of the maximum position adjusting mechanism 81 by the nut 82*c*. A third piston restriction part 82*b* is formed on the adjusting screw 82*a*. A hole 81*d* having a diameter corresponding to the outside diameter of the adjusting screw 82*a* is formed in the adjusting screw 81*a* of the maximum position adjusting mechanism 81. Therefore, the adjusting screw 82*a* can be relatively moved to the adjusting screw 81*a*.

A hole 67*c* having a diameter corresponding to the outside diameter of the adjusting screw 82*a* is formed in the third piston 67. Therefore, the third piston 67 can be moved along the adjusting screw 82*a*. When the third piston 67 moves toward the cover 64, the end face 67*a* of the third piston 67 comes in contact with the adjusting screw 81 a, and the third piston 67 moves toward the first piston 11. Then, the end face 67*b* of the third piston 67 comes in contact with the third piston restriction part 82*b*.

The second middle position adjusting mechanism 83 also has the same structure as the first middle position adjusting mechanism 82 does. Therefore, an adjusting screw 83*a* can be relatively moved to an adjusting screw 84*a*. And, the second piston 12 can be moved along the adjusting screw 83*a*. When the second piston 12 moves toward the cover 65, the end face 12*b* of the second piston 12 comes in contact with the adjusting screw 84*a*, and the second piston 12 moves toward the first piston 11. And, the end face 12*a* of the second piston comes in contact with a second piston restriction part 83*b*.

The first pressure-receiving chamber 13 is formed between the adjusting screw 84*a* and the end face 12*b* of the second piston 12. The second pressure-receiving chamber 14 is formed between the end face 12*a* of the second piston 12 and the end face 11*a* of the first piston 11. The third pressure-receiving chamber 15 is formed between the end face 11*b* of the first piston 11 and the end face 67*b* of the third piston 67. Fourth pressure-receiving chamber 68 is formed between the end face 67*a* of the third piston 67 and the adjusting screw 81*a*.

The first pressure-receiving chamber 13 is a pressure-receiving chamber for acting a pressure on the end face 12*b* of the second piston 12. The second pressure-receiving chamber 14 is a pressure-receiving chamber for applying a pressure to the end face 12*a* of the second piston 12 and the end face 11*a* of the first piston 11. The third pressure-receiving chamber 15 is a pressure-receiving chamber for applying a pressure to the end face 11*a* of the first piston 11 and the end face 67*b* of the third piston 67. The fourth pressure-receiving chamber 68 is a pressure-receiving chamber for applying a pressure to the end face 67*a* of the third piston 67.

Then, the adjusting operations by the adjusting mechanisms 81, 82, 83, 84 will be described.

The maximum position of the first piston 11 is adjusted by the maximum position adjusting mechanism 81.

Specifically, the fixed state of the adjusting screw 81*a* by the nut 81*c* is released to adjust the screw-in amount of the adjusting screw 81*a*, and the adjusting screw 81 a is fixed again to the cover 64 by the nut 81*c* to adjust a relative position of the adjusting screw 81*a* to the cover 64. Thus, the maximum position of the first piston 11 can be adjusted.

First middle position of the first piston 11 is adjusted by the first middle position adjusting mechanism 82.

Specifically, the fixed state of the adjusting screw 82*a* by the nut 82*c* is released to adjust the screw-in amount of the adjusting screw 82*a*, and the adjusting screw 82*a* is fixed again to the adjusting screw 81*a* of the maximum position adjusting mechanism 81 by the nut 82 to adjust a relative position of the adjusting screw 82*a* to the adjusting screw 81*a*. Thus, the first middle position of the first piston 11 can be adjusted.

The second middle position of the first piston 11 is adjusted by the second middle position adjusting mechanism 83. Its adjusting operation is the same to that of the first middle position adjusting mechanism 82.

And, the minimum position of the first piston 11 is adjusted by the minimum position adjusting mechanism 84. Its adjusting operation is the same to that of the maximum position adjusting mechanism 81.

Then, a subject to be positioned by the positioning device 80 is assumed to be a valve plate 46 of variable displacement hydraulic motor 9, and control for switching the capacity of the variable displacement hydraulic motor 9 to four levels will be described with reference to FIG. 17 and FIG. 18.

FIG. 17 schematically shows four positioning states of the positioning device 80. FIG. 17(*a*) shows a state that the variable displacement hydraulic motor 9 has the maximum capacity, FIG. 17(*b*) shows a state that the variable displacement hydraulic motor 9 has a first middle capacity, FIG. 17(*c*) shows a state that the variable displacement hydraulic motor 9 has a second middle capacity, and FIG. 17(*d*) shows a state that the variable displacement hydraulic motor 9 has a minimum capacity. The capacity of the variable displacement hydraulic motor 9 is variable in order of the minimum capacity, the second middle capacity, the first middle capacity and the maximum capacity.

FIG. 18 is a diagram showing a relation between the supply of the pressure oil to the respective pressure-receiving chambers and the capacity of the variable displacement hydraulic motor 9. In FIG. 18, "ON" and "OFF" are used in the same manner as those of FIG. 7. Specifically, "ON" indicates that the pressure oil of a high pressure is supplied to the pressure-receiving chamber, and "OFF" indicates that the pressure oil of a low pressure is supplied to the pressure-receiving chamber. The low pressure state is, for example, a state that the supply of the pressure oil is stopped. And, the "high pressure" is indicated by P, and the "low pressure" is indicated by O.

The first piston 11, the second piston 12 and the third piston 67 can be discontinuously positioned at respective positions by supplying the pressure oil having combinations of high and low pressures shown in FIG. 18 to the pressure-receiving chambers 13, 14, 15, 68 respectively.

Specifically, when it is controlled to supply the pressure oil in the combination shown in the first columns of FIG. 18 to the respective pressure-receiving chambers 13, 14, 15, 68, the second pressure-receiving chamber 14 has a high pressure, the third and fourth pressure-receiving chambers 15, 68 have a low pressure, and the first piston 11 moves in a direction to push the third piston 67 as shown in FIG. 17(*a*). As a result, the third piston 67 is positioned at a position so to come in contact with the adjusting screw 81*a*, and the first piston 11 is positioned at a position to come into contact with the third piston 67. Thus, the first piston 11 is positioned at the maximum position, namely one stroke end position. At this point, first piston valve plate 46 connected to the first piston 11 is positioned at the maximum capacity position. Therefore, the capacity position of the variable displacement hydraulic motor 9 is changed to the maximum capacity position.

And, the supply of the pressure oil in the combination shown in the second columns of FIG. 18 to the respective pressure-receiving chambers 13, 14, 15, 68 is controlled, so that the second and fourth pressure-receiving chambers 14, 68 have a high pressure, and the third pressure-receiving chamber has a low pressure as shown in FIG. 17(*b*). There is a pressure-receiving area difference S4−S2(>0) between pressure-receiving area S2 of the end face 11*a* of the first piston 11 and pressure-receiving area S4 of the end face 67*a* of the third piston 67. Therefore, force F=(S4−S2)·P acts on the first piston 11 and the third piston 67 to move toward the cover 65. The third piston 67 comes in contact with the third piston restriction part 82*b* and its movement is restricted. The first piston 11 comes in contact with the third piston 67. Thus, the third piston 67 is positioned at a position to come into contact with the third piston restriction part 82*b*, and the first piston 11 is positioned at a position to come in contact with the third piston 67. And, the first piston 11 is positioned at the first middle position. At this point, the first piston valve plate 46 is positioned at the first middle capacity position. Therefore, the capacity position of the variable displacement hydraulic motor 9 is changed to the first middle capacity position.

And, when it is controlled to supply the pressure oil in the combination of the third columns of FIG. 18 to the respective pressure-receiving chambers 13, 14, 15, 68, the first and third pressure-receiving chambers 13, 15 have a high pressure and the second pressure-receiving chamber 14 has a low pressure as shown in FIG. 17(*c*). There is pressure-receiving area difference S1−S3(>0) between the pressure-receiving area S3 of the end face 11*b* of the first piston 11 and the pressure-receiving area S1 of the end face 12*b* of the second piston 12. Therefore, force F=(S1−S3)·P acts on the first piston 11 and the second piston 12 to move toward the cover 64. The second piston 12 comes in contact with the second piston restriction part 83*b* and its movement is restricted. The first piston 11 comes in contact with the second piston 12. Thus, the second piston 12 is positioned at a position to come into contact with the second piston restriction part 83*b*, and the first piston 11 is positioned at a position to come into contact with the second piston 12. Thus, the first piston 11 is positioned at the second middle position. At this point, the first piston valve plate 46 is positioned at the second middle capacity position. Therefore, the capacity position of the variable displacement hydraulic motor 9 is changed to the second middle capacity position.

And, when it is controlled to supply the pressure oil in the combination of the fourth columns of FIG. 18 to the respective pressure-receiving chambers 13, 14, 15, 68, the third pressure-receiving chamber 15 has a high pressure, the first and second pressure-receiving chambers 13, 14 have a low pressure, and the first piston 11 moves in a direction to push the second piston 12 as shown in FIG. 17(*d*). As a result, the second piston 12 is positioned at a position to come into contact with the adjusting screw 84*a*, and the first piston 11 is positioned at a position to come in contact with the second piston 12. Thus, the first piston 11 is positioned at the minimum position, namely another stroke end position. At this point, the first piston valve plate 46 is positioned at the minimum capacity position. Therefore, the capacity position of the variable displacement hydraulic motor 9 is changed to the minimum capacity position.

Figure 10:
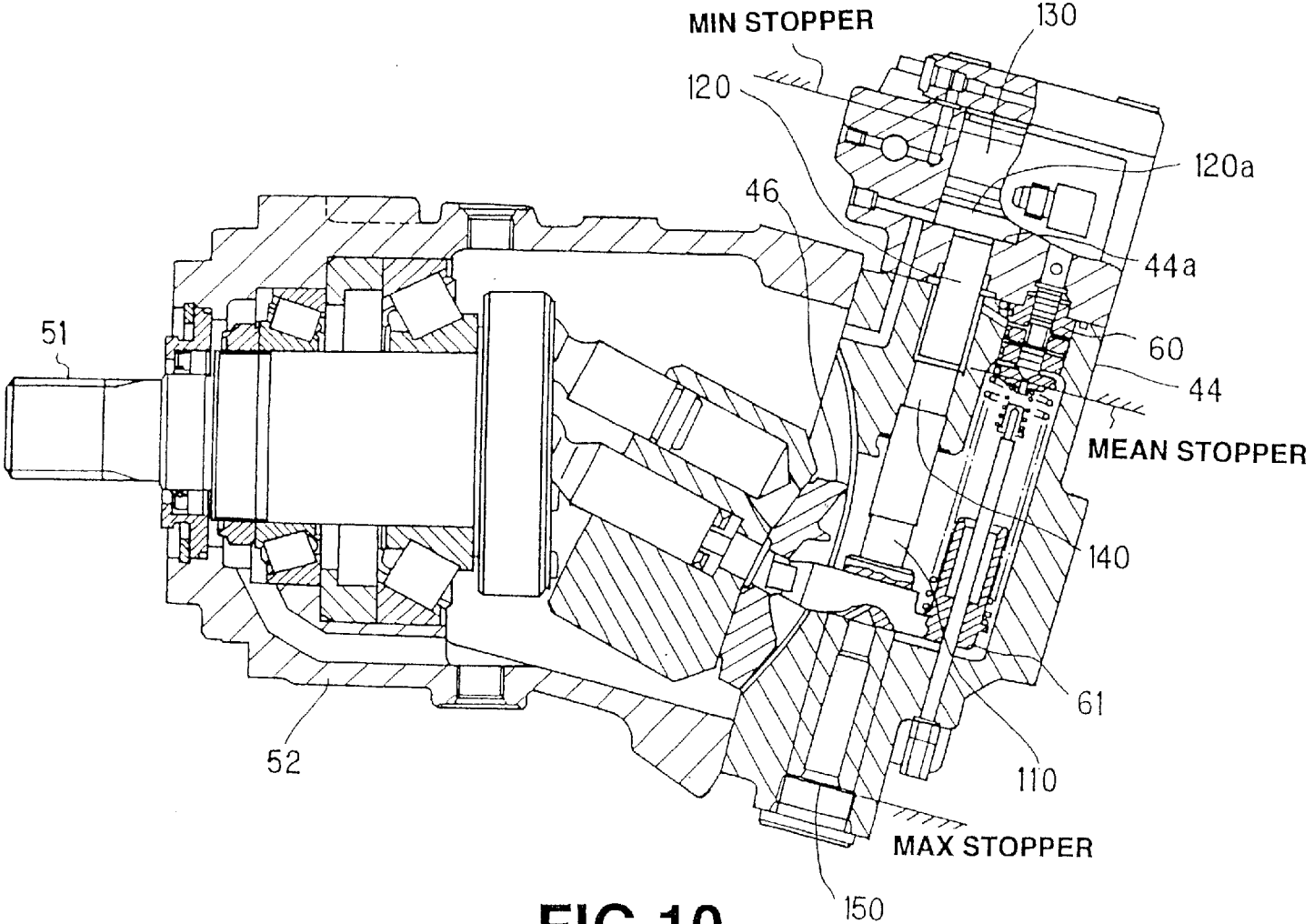
FIG.10 (PRIOR ART)
FIG. 10 is a sectional diagram of the conventional hydraulic motor.

As described above, according to this embodiment, the capacity position of the hydraulic motor 9 which is subject to positioning can be switched by discontinuously positioning the first piston 11, the second piston 12 and the third piston 67 at the respective positions. Therefore, as shown in FIG. 10, the positioning number of the positioning device can be increased to three or more by a simple structure and simple control, and the capacity position of the hydraulic motor can be switched without using the complex structure such as the servo valves and complex control. Therefore, the hydraulic equipment such as the hydraulic pump can be made compact in size.

Then, a positioning device 85 which can position at six positions such as a maximum position, a first middle position, a second middle position, a third middle position, a fourth middle position and a minimum position will be described with reference to FIG. 19.

Figure 19A:
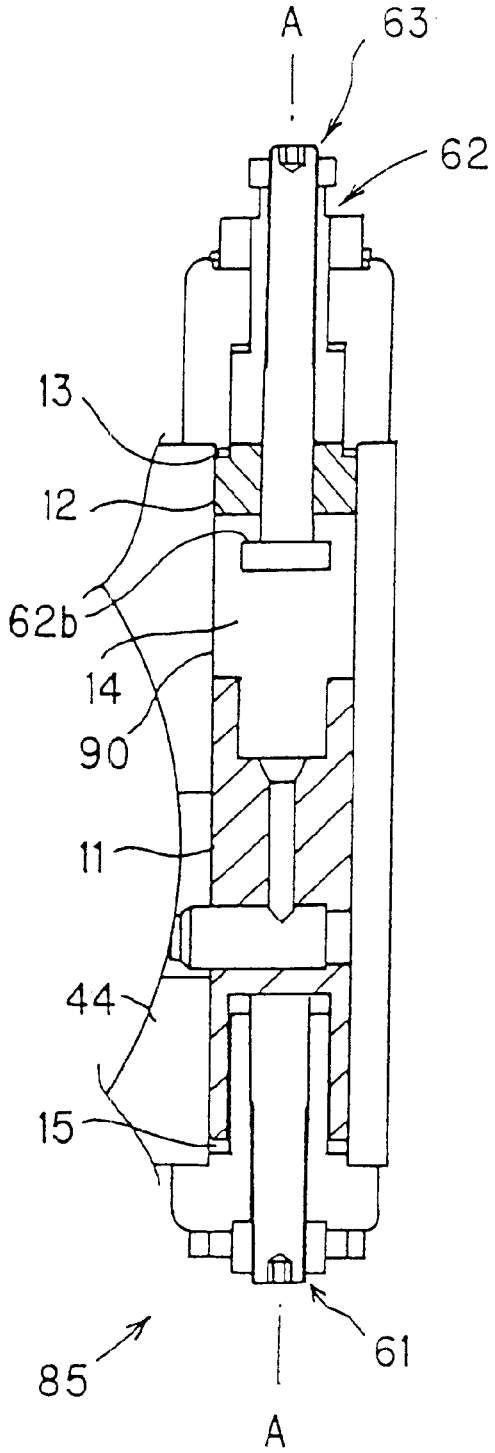
FIG. 19 is a sectional diagram showing a positioning device which can make positioning at six positions.
Figure 19B:
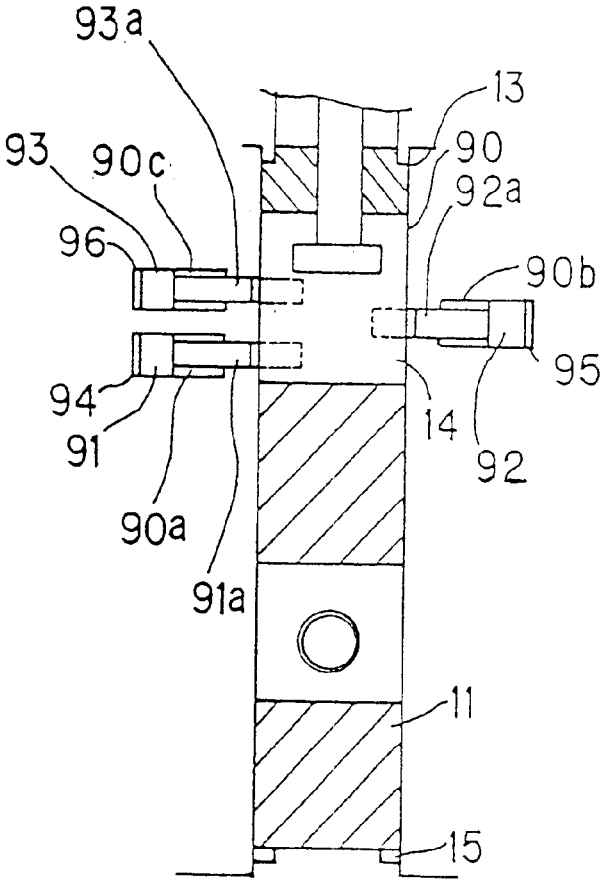

FIG. 19(*a*) is a sectional diagram of the positioning device 85, and FIG. 19(*b*) is a partial sectional diagram taken along line A—A of the positioning device 85 of FIG. 19(*a*).

The positioning device 85 shown in FIG. 19 has the first piston 11 positioned at the respective positions according to the positional relation among the first piston 11, the second piston 12 and the second piston restricting part 62*b* in the same way as the positioning device 66 shown in FIG. 12. But, three pistons 91 to 93 which restrict the movement of the first piston 11 are disposed in addition to the first piston 11 and the second piston 12 to freely project into the second pressure-receiving chamber 14. Differences from the aforesaid positioning device 66 of FIG. 12 will be mainly described, and the same portions will be omitted from being described if not necessary.

The body 44 is formed with holes 90*a*, 90*b*, 90*c* as well as hole 90. The holes 90*a*, 90*b*, 90*c* are formed in the body 44 so that their center axes are perpendicular to the center axis of the hole 90. The hole 90*a* is formed to be closest to the third pressure-receiving chamber 15, the hole 90*c* is formed to be closest to the first pressure-receiving chamber 13, and the hole 90*b* is formed at the middle of them.

The third piston 91 is disposed to be freely slidable in the hole 90*a*. A first piston restricting part 91*a* is formed on the third piston 91. A fourth pressure-receiving chamber 94 is formed in the hole 90*a* and applies a pressure to the third piston 91. When the fourth pressure-receiving chamber 94 has a high pressure, the third piston 91 slides within the hole 90*a*, and the first piston restricting part 91*a* protrudes into the second pressure-receiving chamber 14.

Similarly, the fourth piston 92 is disposed to be freely slidable within the hole 90*b*. The first piston restricting part 92*a* is formed on the fourth piston 92. A fifth pressure-receiving chamber 95 is formed within the hole 90*b* to apply a pressure to the fourth piston 92. When the fifth pressure-receiving chamber 95 has a high pressure, the fourth piston 92 slides within the hole 90*b*, and the first piston restricting part 92*a* protrudes into the second pressure-receiving chamber 14.

Similarly, the fifth piston 93 is disposed to be freely slidable in the hole 90*c*. A first piston restricting part 93*a* is formed on the fifth piston 93. A sixth pressure-receiving chamber 96 is formed within the hole 90*c* to apply a pressure to the fifth piston 93. When the sixth pressure-receiving chamber 96 has a high pressure, the fifth piston 93 slides within the hole 90*c*, and the first piston restricting part 93*a* protrudes into the second pressure-receiving chamber 14.

Then, it is assumed that the subject to be positioned by the positioning device 85 is the valve plate 46 of the variable displacement hydraulic motor 9, and the control to switch the capacity of the variable displacement hydraulic motor 9 to six levels will be described. The capacity of the variable displacement hydraulic motor 9 varies in the six levels in order of the minimum capacity, the fourth middle capacity, the third middle capacity, the second middle capacity, the first middle capacity and the maximum capacity.

The positioning device 85 shown in FIG. 19 can position discontinuously the first piston 11, the second piston 12, the third piston 91, the fourth piston 92 and the fifth piston 93 at the respective positions by supplying the pressure oil having a combination of high and low pressures to the respective pressure-receiving chambers 13, 14, 15, 94, 95, 96.

First, it is assumed that the pressure oil of a low pressure is supplied to the fourth pressure-receiving chamber 94, the fifth pressure-receiving chamber 95 and the sixth pressure-receiving chamber. At this point, the pressure oil to the first pressure-receiving chamber 13, the second pressure-receiving chamber 14 and the third pressure-receiving chamber 15 is controlled in the same way as in FIG. 7, so that the positioning device 85 operates in the same way as the aforesaid positioning device 45 or 66.

Specifically, the first piston 11 has a state as shown in FIG. 19 and positioned at the stroke end position away from the second piston 12 by controlling the first pressure-receiving chamber 13, the second pressure-receiving chamber 14 and the third pressure-receiving chamber 15 to have a low pressure, a high pressure and a high pressure respectively. In other words, it is positioned at the maximum position.

And, the first piston 11 is positioned at the fourth middle position to come in contact with the second piston 12 whose movement is restricted by the second piston restricting part 62*b* by controlling the first pressure-receiving chamber 13, the second pressure-receiving chamber 14 and the third pressure-receiving chamber 15 to have a high pressure, a low pressure and a high pressure respectively.

And, the first piston 11 is positioned at the stroke end position to come in contact with the second piston 12 whose movement is not restricted by the second piston restricting part 62*b* by controlling the first pressure-receiving chamber 13, the second pressure-receiving chamber 14 and the third pressure-receiving chamber 15 to have a low pressure, a low pressure and a high pressure respectively. In other words, it is positioned at the minimum position.

As described above, when the first piston 11 is changed to the maximum position, the fourth middle position and the minimum position, the variable displacement hydraulic motor 9 is changed to have the maximum capacity, the fourth middle capacity and the minimum capacity respectively.

And, the variable displacement hydraulic motor 9 is changed its capacity to the first middle capacity, the second middle capacity and the third middle capacity when the first piston 11 is changed to the first middle position, the second middle position and the third middle position as described below.

When the first piston 11 is to be positioned at the first middle position, the second middle position or the third middle position, the pressure oil of a low pressure is supplied to the second pressure-receiving chamber 14, and the pressure oil of a high pressure is supplied to the third pressure-receiving chamber 15. When it is controlled so that the second pressure-receiving chamber 14 has a low pressure and the third pressure-receiving chamber 15 is controlled to have a high pressure, the first piston 11 moves toward the second piston 12.

When the first piston 11 is positioned at the first middle position, the pressure oil of a high pressure is supplied to the fourth pressure-receiving chamber 94, and the pressure oil of a low pressure is supplied to the other fifth and sixth pressure-receiving chambers 95, 96. Therefore, the first piston restricting part 91*a* of the third piston 91 protrudes into the second pressure-receiving chamber 14 as indicated by a broken line in FIG. 19(*b*). Thus, the movement of the first piston 11 is restricted by the first piston restricting part 91*a*, and the first piston 11 is positioned at the first middle position.

Similarly, when the first piston 11 is to be positioned at the second middle position, the pressure oil of a high pressure is supplied to the fifth pressure-receiving chamber 95, and the pressure oil of a low pressure is supplied to the fourth and sixth pressure-receiving chambers 94, 96. Therefore, the first piston restricting part 92*a* of the fourth piston 92 protrudes into the second pressure-receiving chamber 14 as indicated by a broken line in FIG. 19(*b*). Thus, the movement of the first piston 11 is restricted by the first piston restricting part 92*a*, and the first piston 11 is positioned at the second middle position.

Similarly, when the first piston 11 is to be positioned at the third middle position, the pressure oil of a high pressure is supplied to the sixth pressure-receiving chamber 96, and the pressure oil of a low pressure is supplied to the fourth and fifth pressure-receiving chambers 94, 95. Therefore, the first piston restricting part 93*a* of the fifth piston 93 protrudes into the second pressure-receiving chamber 14 as indicated by a broken line in FIG. 19(*b*). Thus, the movement of the first piston 11 is restricted by the first piston restricting part 93*a*, and the first piston 11 is positioned at the third middle position.

As described above, according to the positioning device 85 of FIG. 19, the capacity position of the hydraulic motor 9 which is subject to positioning can be switched to the six levels by discontinuously positioning the first piston 11, the second piston 12, the third piston 91, the fourth piston 92 and the fifth piston 93 at the respective positions. By disposing more pistons for restricting the movement of the first piston 11, positioning can be made at more positions.

The positioning device 80 and the positioning device 85 shown in FIG. 16 and FIG. 19 have the adjusting screw and the nut to configure the maximum capacity adjusting mechanism, the first middle capacity adjusting mechanism, the second middle capacity adjusting mechanism and the minimum capacity adjusting mechanism so to adjust the capacity position. But, such a configuration is not limitative, but the positions to restrict the movement of the first piston 11, the second piston 12 and the third piston 67 may be adjusted by an eccentric cam, shim or electromagnetic solenoid for adjusting the capacity position.

The embodiments shown in FIG. 16 and FIG. 19 may be used for the inclined shaft type axial piston motor (pump) and also be used for a swash plate type motor or pump or a radial type motor or pump.

The aforesaid positioning device 80 can be mounted on the HST vehicle to control its running.

Figure 20:
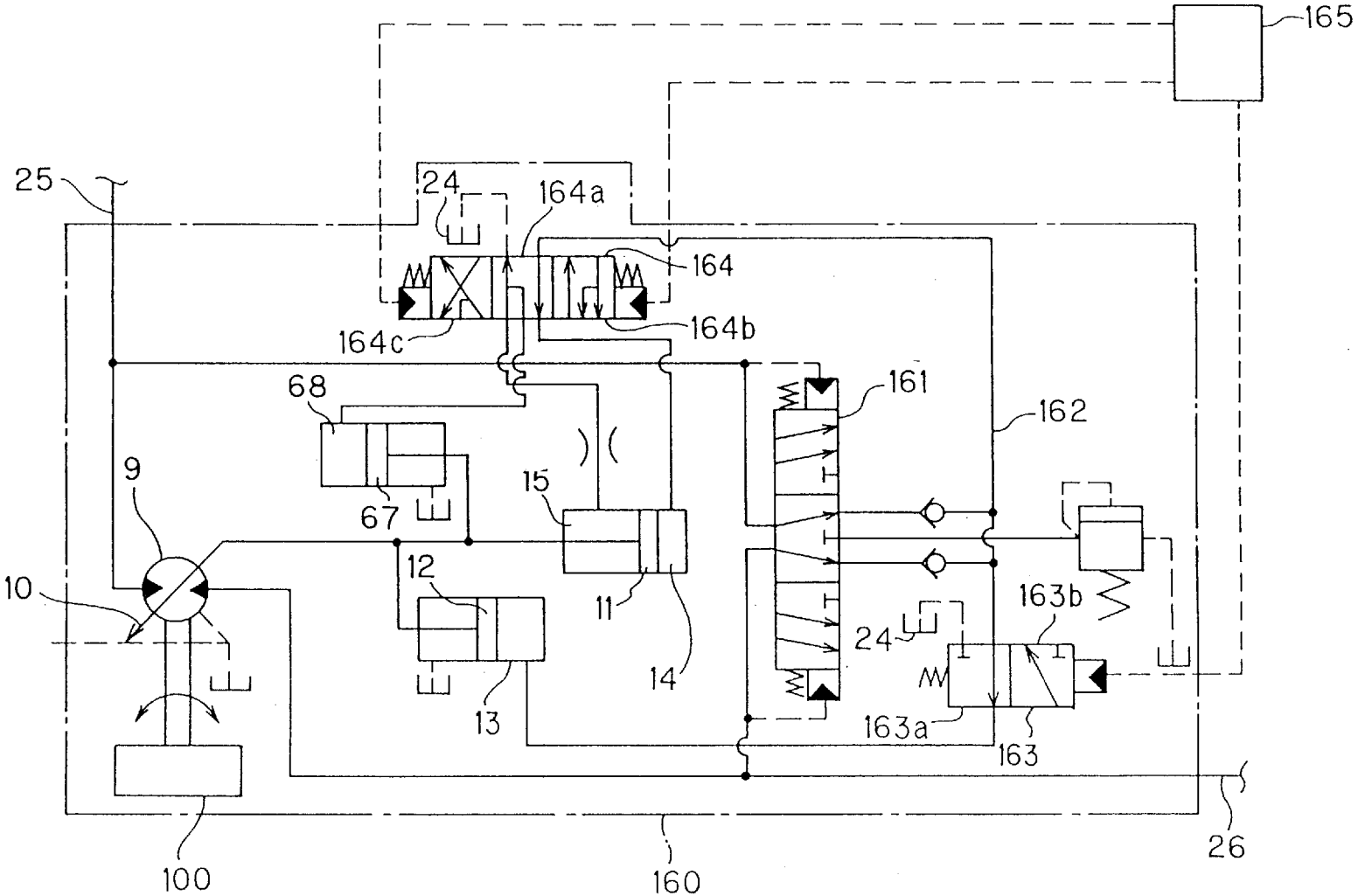
FIG. 20 is an oil hydraulic circuit chart of a motor mechanism which can change the speed among four speeds.

FIG. 20 is an oil hydraulic circuit chart of the HST vehicle whose running is controlled by the positioning device 80. A motor mechanism 160 shown in FIG. 20 corresponds to the left motor mechanism 8 of FIG. 14. The right motor mechanism 8' is also the same as the motor mechanism 160 but its corresponding one is not shown. In FIG. 20, like reference numerals are used to indicate the like components of FIG. 14 and FIG. 16, and their descriptions are omitted. The left hydraulic motor 9 will be described below as means for changing the speed among a first speed "Lo", a second speed "Mid1", a third speed "Mid2" and a fourth speed "Hi". It becomes fast in order of the first speed "Lo", the second speed "Mid1", the third speed "Mid2" and the fourth speed "Hi", and the first speed "Lo", the second speed "Mid1", the third speed "Mid2" and the fourth speed "Hi" correspond to the maximum capacity, the first middle capacity, the second middle capacity and the minimum capacity respectively. When the speed is changed in order of the first speed "Lo", the second speed "Mid1", the third speed "Mid2" and the fourth speed "Hi", the rotation speed of the left caterpillar 100 corresponding to the hydraulic motor 9 changes in order of the minimum rotation speed, the first middle speed, the second middle speed and the maximum rotation speed.

A high-pressure selecting valve 161 is a selector valve for selecting the pressure oil of a high pressure between a pressure of the pressure oil in the pipe 25 and a pressure of the pressure oil in the pipe 26. When the pressure oil in the pipe 25 and the pressure oil in the pipe 26 have the same pressure, both of them are selected.

The pressure oil selected by the high-pressure selecting valve 161 is discharged to a pipe 162.

The pipe 162 is connected to a 2-position selector valve 163 and a 3-position selector valve 164.

A switch 165 is a switch which is operated from outside to select the speed "Lo", "Mid1", "Mid2" or "Hi" of the HST vehicle and to output a signal for switching the valve positions of the 2-position selector valve 163 and 3-position selector valve 164 to the 2-position selector valve 163 and the 3-position selector valve 164. According to the operation of the switch 165, a pilot pressure oil is supplied to the 2-position selector valve 163 and the 3-position selector valve 164. It may be configured to switch between the 2-position selector valve 163 and the 3-position selector valve 164 by sending an electric signal to the 2-position selector valve 163 and the 3-position selector valve 164 according to the operation of the switch 165.

The 2-position selector valve 163 has two valve positions, namely middle/maximum position 163*a* and minimum position 163*b*. The 2-position selector valve 163 is supplied with a pilot pressure oil according to the operation of the switch 165, and the valve position is switched. When the valve position of the 2-position selector valve 163 is switched to the middle/maximum position 163*a*, the pipe 162 is communicated with first pressure-receiving chamber 13, and when it is switched to the minimum position 163*b*, the tank 24 is communicated with the first pressure-receiving chamber 13.

The 3-position selector valve 164 has three valve positions, namely maximum position 164*a*, first middle position 164*b*, and second middle/minimum position 164*c*. Similar to the 2-position selector valve 163, the 3-position selector valve 164 is supplied with the pilot pressure oil according to the operation of the switch 165, and the valve position is switched. When the valve position of the 3-position selector valve 164 is switched to the maximum position 164*a*, the pipe 162 is communicated with the second pressure-receiving chamber 14, and the tank 24, the third pressure-receiving chamber 15 and the fourth pressure-receiving chamber 68 are communicated to one another. When the valve position of the 3-position selector valve 164 is switched to the first middle position 164*b*, the pipe 162, the second pressure-receiving chamber 14 and the fourth pressure-receiving chamber 68 are communicated to one another, and the tank 24 is communicated with the third pressure-receiving chamber 15. When the valve position of the 3-position selector valve 164 is switched to the second middle/minimum position 164*c*, the pipe 162 is communicated with the third pressure-receiving chamber 15, and the tank 24, the second pressure-receiving chamber 14 and the fourth pressure-receiving chamber 68 are communicated to one another.

Then, descriptions will be made about relations between the valve positions of the selector valves 163, 164 and the supply of the pressure oil to the pressure-receiving chambers 13, 14, 15, 68 when the motor mechanism 160 is changed its speed among the four speeds, namely the first speed "Lo", the second speed "Mid1", the third speed "Mid2" and the fourth speed "Hi".

FIG. 21 is a diagram showing the relations among ON/OFF (high pressure/low pressure) of the supply of the pressure oil to the first, second, third and fourth pressure-receiving chambers 13, 14, 15, 68, the capacity of the hydraulic motor 9 and the speeds selected by the switch 165. Similar to FIG. 15, "ON" indicates that the pressure oil of a high pressure is supplied to the pressure-receiving chamber, and "OFF" indicates that the pressure oil of a low pressure is supplied to the pressure-receiving chamber. The low pressure state is, for example, a state that the supply of the pressure oil is stopped. In FIG. 21, the combination of the first columns (ON, ON, OFF, OFF) corresponds to that of the first columns of FIG. 18. The combination of the second columns (ON, ON, OFF, ON) corresponds to the combination of the second columns of FIG. 18. The combination of the third columns (ON, OFF, ON, OFF) corresponds to the combination of the third columns of FIG. 18. The combination of the fourth columns (OFF, OFF, ON, OFF) corresponds to the combination of the fourth columns of FIG. 18.

Thus, the combinations of the supply of the pressure oil to the pressure-receiving chambers 13, 14, 15, 68 are previously determined. When any speed is selected by the switch 165, a pilot signal is output to the 2-position selector valve 163 and the 3-position selector valve 164 so that the pressure of the pressure oil supplied to the pressure-receiving chambers 13, 14, 15, 68 has a combination corresponding to the selected speed.

When the first speed "Lo" is selected by the switch 165, a pilot pressure for changing the speed of the hydraulic motor 9 to the first speed is entered the 2-position selector valve 163 and the 3-position selector valve 164. As a result, the valve position of the 2-position selector valve 163 is switched to the middle/maximum position 163*a*, and the valve position of the 3-position selector valve 164 is switched to the maximum position 164*a*. Therefore, the pressure oils of high pressure (ON), high pressure (ON), low pressure (OFF) and low pressure (OFF) are supplied to the first, second, third and fourth pressure-receiving chambers 13, 14, 15, 68 of the motor mechanism 160 respectively. Thus, the hydraulic motor 9 has a state positioned at the maximum capacity position shown in FIG. 17(*a*). At this point, the center shaft 10 of the hydraulic motor 9 is changed to have an angle corresponding to the maximum capacity position.

The hydraulic motor 9' also operates in the same way.

Thus, the capacity positions of the left and right hydraulic motors 9, 9' are switched to the maximum capacity position, and the left and right hydraulic motors 9, 9' are changed their speeds to the first speed "Lo" at the minimum rotation speed with maximum torque. Accordingly, the left and right caterpillars 100, 100' have the minimum rotation speed.

When the second speed "Mid1" is selected by the switch 165, a pilot pressure for changing the hydraulic motor 9 to the second speed is entered the 2-position selector valve 163 and the 3-position selector valve 164. The valve position of the 2-position selector valve 163 is switched to the middle/maximum position 163*a*, and the valve position of the 3-position selector valve 164 is switched to the first middle position 164*b*. Therefore, the pressure oils of high pressure (ON), high pressure (ON), low pressure (OFF) and high pressure (ON) are supplied to the first, second, third and fourth pressure-receiving chambers 13, 14, 15, 68 of the motor mechanism 160. Thus, the hydraulic motor 9 has a state positioned at the first middle capacity position shown in FIG. 17(*b*). At this point, the center shaft 10 of the hydraulic motor 9 is changed to have an angle corresponding to the first middle capacity position.

The hydraulic motor 9' also operates in the same way.

Thus, the capacity positions of the left and right hydraulic motors 9, 9' are switched to the first middle capacity position, and the left and right hydraulic motors 9, 9' are changed their speeds to the second speed "Mid". The left and right caterpillars 100, 100' have the first middle rotation speed.

When the third speed "Mid2" is selected by the switch 165, a pilot pressure for changing the hydraulic motor 9 to the third speed is entered the 2-position selector valve 163 and the 3-position selector valve 164. The valve position of the 2-position selector valve 163 is switched to the middle/maximum position 163*a*, and the valve position of the 3-position selector valve 164 is switched to the second middle/minimum position 164*c*. Therefore, the pressure oils of high pressure (ON), low pressure (OFF), high pressure (ON) and low pressure (OFF) are supplied to the first, second, third and fourth pressure-receiving chambers of the motor mechanism 160. Thus, the hydraulic motor 9 has a state positioned at the second middle capacity position shown in FIG. 17(*c*). At this point, the center shaft 10 of the hydraulic motor 9 is changed to have an angle corresponding to the second middle capacity position.

The hydraulic motor 9' also operates in the same way.

Thus, the capacity positions of the left and right hydraulic motors 9, 9' are switched to the second middle capacity position, and the left and right hydraulic motors 9, 9' are changed their speeds to the third speed "Mid2". Thus, the left and right caterpillars 100, 100' have the second middle rotation speed.

When the fourth speed "Hi" is selected by the switch 165, a pilot pressure for changing the speed of the hydraulic motor 9 to the fourth speed is entered the 2-position selector valve 163 and the 3-position selector valve 164. The valve position of the 2-position selector valve 163 is switched to the minimum position 163*b*, and the valve position of the 3-position selector valve 164 is switched to the second middle/minimum position 164*c*. Therefore, the pressure oils of low pressure (OFF), low pressure (OFF), high pressure (ON) and low pressure (OFF) are supplied to the first, second, third and fourth pressure-receiving chambers of the motor mechanism 160 as shown in FIG. 21. Thus, the hydraulic motor 9 has a state positioned at the minimum capacity position shown in FIG. 17(*d*). At this point, the center shaft 10 of the hydraulic motor 9 is changed to have an angle corresponding to the minimum capacity position.

The hydraulic motor 9' also operates in the same way.

Thus, the capacity positions of the left and right hydraulic motors 9, 9' are switched to the minimum capacity position, and the left and right hydraulic motors 9, 9' are changed to the fourth speed "Hi" at the maximum rotation speed with minimum torque. Thus, the left and right caterpillars 100, 100' have the maximum rotation speed.

The aforesaid embodiment was described on the assumption that the positioning device 80 was mounted on the HST vehicle to control its running. It is not limited to the positioning device 80, and the positioning device 85 may be also mounted on the HST vehicle to control its running.

The above embodiment was also described on the assumption that the speed is changed manually among the four speeds. But, the speed change between any speeds can be made automatically.

What is claimed is:

1. A positioning device comprising:

a first piston and a second piston in a body, the first piston and the second piston having a same outside diameter, the first piston having a position restricted by the body and a position corresponding to a position of the second piston as stop positions, and the second piston having a position restricted by the body and a position restricted by a second piston restricting part as stop positions;

a first pressure chamber for applying a pressure to the second piston in a direction of the first piston;

a second pressure chamber for applying a pressure in a direction to separate the first piston and the second piston from each other;

a third pressure chamber for applying a pressure to the first piston in a direction of the second piston, a first adjusting mechanism for dynamically adjusting a stop position of the first piston; and a second adjusting mechanism for dynamically adjusting a stop position of the second piston, wherein:

a pressure-receiving area of the second piston is made greater than a pressure-receiving area of the first piston to thereby make the pressure of the second piston greater than the pressure of the first piston.

2. A capacity controller for a variable displacement piston machine using the positioning device of claim 1, wherein the first piston is connected to a capacity control member of the variable displacement piston machine to control a capacity position of the variable displacement piston machine.

3. A positioning device for changing a position of a subject to be positioned depending on a moved position of a piston, comprising:

the piston which moves between both stroke end positions to change the position of the subject to be positioned from a minimum position to a maximum position;

three or more restricting members which are positioned at three or more middle positions of between the both stroke end positions to restrict the movement of the piston at three or more middle positions; and position control means which changes the position of the subject to be positioned among five or more positions by the piston and the restricting members.

4. A speed changing device, comprising a variable displacement hydraulic motor which rotatably drives rotating bodies; a hydraulic pump which supplies pressure oil to the variable displacement hydraulic motor; and speed switching means which changes rotation speeds of the rotating bodies by changing a capacity position of the variable displacement hydraulic motor, wherein the speed switching means includes:

a piston which changes the capacity position of the variable displacement hydraulic motor from a minimum capacity position to a maximum capacity position by moving between both stroke end positions;

three or more restricting members which restrict the movement of the piston at three or more middle positions by being positioned at three or more middle positions between the both stroke end positions; and position control means which changes the rotation speeds of the rotating bodies among five or more levels by the piston and the restricting members.

5. A speed changing device of rotating bodies using the hydraulic motor of claim 4, wherein the position control means comprises:

respective pressure-receiving chambers which apply the pressure oil to the piston and the three or more restricting members; and pressure oil supply means which previously determines combinations of high and low pressures of the pressure oil supplied to the respective pressure-receiving chambers for the respective rotation speeds of the rotating bodies and supplies the pressure oil having the combinations of high and low pressures corresponding to the rotation speed to be changed to the pressure-receiving chambers, respectively.

6. A positioning device comprising:

a first piston, a second piston and a third piston in a body, the first piston, the second piston and the third piston having a same outside diameter, the first piston having a position corresponding to a position of the second piston and a position corresponding to a position of the third piston as stop positions, the second piston having a position restricted by the body and a position restricted by a second piston restricting part as stop positions, and the third piston having a position restricted by the body and a position restricted by a third piston restricting part as stop positions;

a first pressure chamber for applying a pressure to the second piston in a direction of the first piston;

a second pressure chamber for applying a pressure in a direction to separate the first piston and the second piston from each other;

a third pressure chamber for applying a pressure in a direction to separate the first piston and the third piston from each other;

a fourth pressure chamber for applying a pressure to the third piston in the direction of the first piston;

a first adjusting mechanism for adjusting a stop position of the second piston; and a second adjusting mechanism for adjusting a stop position of the third piston, wherein:

pressure-receiving areas of the second piston and the third piston are made greater than a pressure-receiving area of the first piston to thereby make the pressure of the second piston and the pressure of the third piston greater than the pressure of the first piston.

7. A positioning device comprising:

a body having a hole;

a piston sliding in the hole; and one or more of piston restriction members moving in a direction perpendicular to a sliding direction of the piston so as to be freely movable from and to the hole, wherein:

both stroke ends of the piston and positions where one or more of the piston restricting members expand are determined as stop positions of the piston.

* * * * *